US012747122B2

(12) United States Patent
Ito

(10) Patent No.: US 12,747,122 B2
(45) Date of Patent: Sep. 29, 2026

(54) MEDIA CONVEYING APPARATUS

(71) Applicant: PFU LIMITED, Kahoku (JP)

(72) Inventor: Takumi Ito, Kahoku (JP)

(73) Assignee: PFU LIMITED, Kahoku (JP)

( * ) Notice: Subject to any disclaimer, the term of this patent is extended or adjusted under 35 U.S.C. 154(b) by 0 days.

(21) Appl. No.: 18/750,624

(22) Filed: Jun. 21, 2024

(65) Prior Publication Data

US 2025/0002280 A1 Jan. 2, 2025

(30) Foreign Application Priority Data

Jun. 30, 2023 (JP) ..... 2023-108406

(51) Int. Cl.
*B65H 31/20* (2006.01)
*B65H 5/06* (2006.01)
*B65H 15/00* (2006.01)

(52) U.S. Cl.
CPC ..... *B65H 5/062* (2013.01); *B65H 5/068* (2013.01); *B65H 15/004* (2020.08); *B65H 31/20* (2013.01); *B65H 2511/24* (2013.01); *B65H 2511/52* (2013.01); *B65H 2553/25* (2013.01); *B65H 2557/264* (2013.01); *B65H 2801/39* (2013.01)

(58) Field of Classification Search
CPC ..... B65H 5/062; B65H 5/068; B65H 15/004; B65H 31/20; B65H 2511/24; B65H 2511/52; B65H 2553/25; B65H 2557/26; B65H 2801/39
See application file for complete search history.

(56) References Cited

U.S. PATENT DOCUMENTS

2009/0206539 A1* 8/2009 Takeuchi ..... B65H 31/02 271/3.14
2021/0179374 A1* 6/2021 Ikeda ..... B65H 7/02
2021/0188581 A1* 6/2021 Niwata ..... B65H 3/0661

FOREIGN PATENT DOCUMENTS

JP 2004-182449 A 7/2004
JP 2017-147605 A 8/2017

* cited by examiner

*Primary Examiner* — Thomas A Morrison
(74) *Attorney, Agent, or Firm* — Womble Bond Dickinson (US) LLP

(57) ABSTRACT

A media conveying apparatus includes a feed table on which a medium is placed, a conveyor to convey the medium placed on the feed table, a sensor to detect floating of the medium conveyed by the conveyor, an ejector to eject the medium conveyed by the conveyor, an ejection tray located above the feed table to stack the medium ejected by the ejector, and an extension tray connected to a downstream side of the ejection tray in a media ejection direction. In a state where the medium ejected from the ejector is stacked on the ejection tray and the extension tray, a lower end portion of the extension tray on an upstream side in the media ejection direction is located closer to the feed table than a lower end portion of the ejection tray on a downstream side in the media ejection direction.

8 Claims, 21 Drawing Sheets

MEDIA CONVEYING APPARATUS

CROSS-REFERENCE TO RELATED APPLICATION

This patent application is based on and claims priority pursuant to 35 U.S.C. § 119(a) to Japanese Patent Application No. 2023-108406, filed on Jun. 30, 2023, in the Japan Patent Office, the entire disclosure of which is hereby incorporated by reference herein.

BACKGROUND

The present disclosure relates to a media feeding apparatus.

In a media conveying apparatus such as a scanner, generally, the floating of a medium to be conveyed may occur.

A sheet feeding apparatus that stops the operation of a sheet feeding unit when an abnormal shape of a sheet is detected has been proposed.

An image reading apparatus that includes a document deflection detection unit that detects a document deflection, and a staple determination unit that determines whether documents are stapled based on a detection result of the document deflection detection unit has been proposed.

SUMMARY

A media conveying apparatus according to one aspect of the present disclosure includes a feed table on which a medium is placed, a conveyor to convey the medium placed on the feed table, a sensor to detect floating of the medium conveyed by the conveyor, an ejector to eject the medium conveyed by the conveyor; an ejection tray located above the feed table to stack the medium ejected by the ejector, and an extension tray connected to a downstream side of the ejection tray in a media ejection direction. In a state where the medium ejected from the ejector is stacked on the ejection tray and the extension tray, a lower end portion of the extension tray on an upstream side in the media ejection direction is located closer to the feed table than a lower end portion of the ejection tray on a downstream side in the media ejection direction.

A media conveying apparatus according to one aspect of the present disclosure includes a feed table on which a medium is placed, a conveyor to convey the medium placed on the feed table, a sensor to detect floating of the medium conveyed by the conveyor, and a guide to guide the medium conveyed by the conveyor to the sensor. The guide has a guide face with no step.

A media conveying apparatus according to one aspect of the present disclosure includes a feed table on which a medium is placed, a conveyor to convey the medium placed on the feed table, a sensor to detect floating of the medium conveyed by the conveyor, an ejector to eject the medium conveyed by the conveyor, and a tray located above the feed table to stack the medium ejected by the ejector. The tray includes a base, and an attachment connected to at least one of a left side or a right side of the base. A lower end of the base is located closer to the feed table than a lower end of the attachment. Lower left and right end portions of a projection of the base projecting more downstream than the attachment in a media ejection direction have no step. A lower end portion of the attachment on a downstream side in the media ejection direction have no step.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
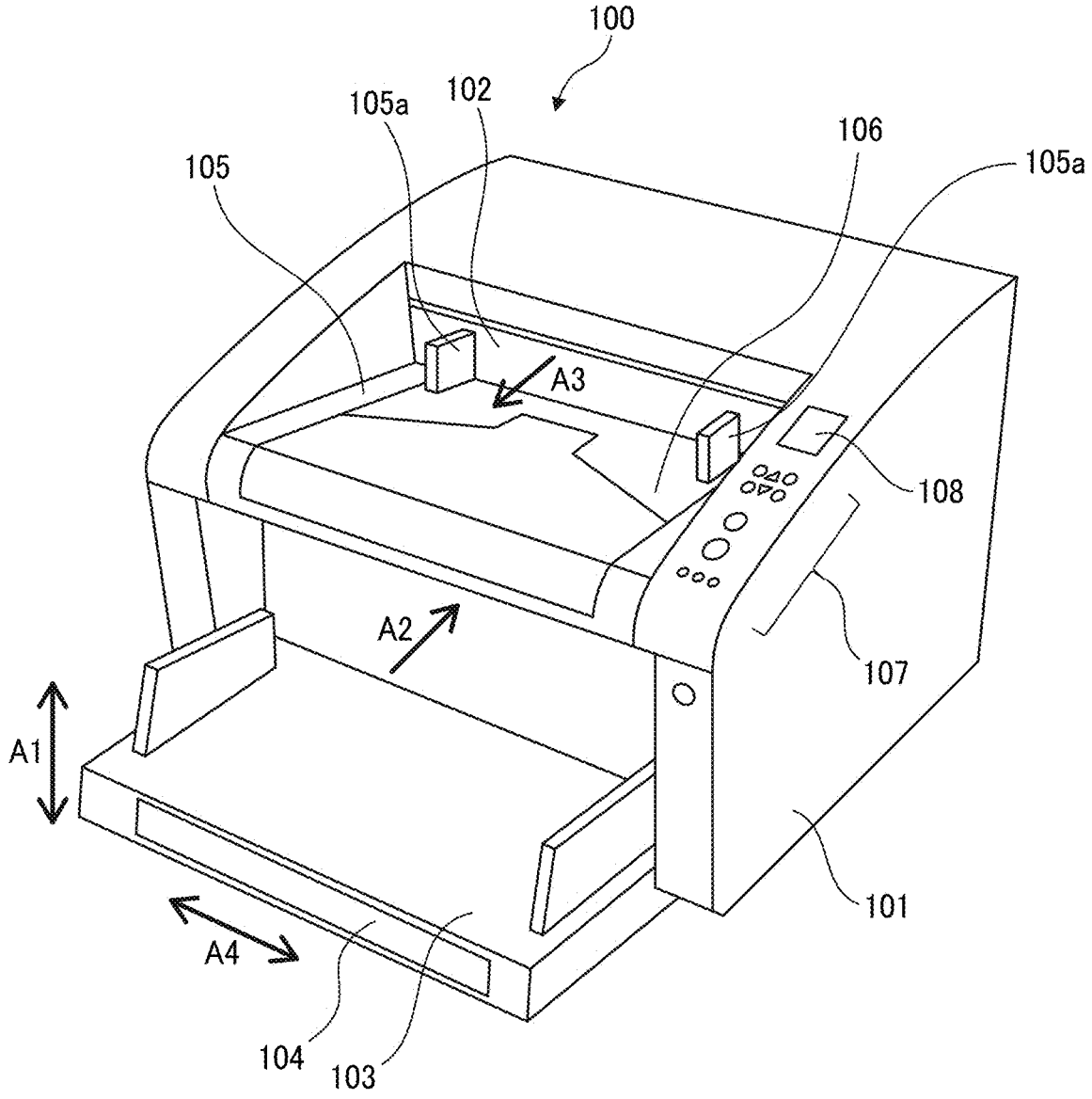
FIG. 1 is a perspective view of a media conveying apparatus.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

A media conveying apparatus, a media conveying method, and a control program according to an aspect of the present disclosure are described below with reference to the drawings. The technical scope of the present disclosure, however, is not limited to the embodiments described below but includes the scope of the appended claims and the equivalents thereof.

FIG. 1 is a perspective view of a media conveying apparatus 100 configured as an image scanner. The media conveying apparatus 100 conveys and images media, which are original documents. The media are, for example, sheets of plain paper, sheets of thick paper, or cards. Alternatively, the media conveying apparatus 100 may be, for example, a facsimile machine, a copier, or a multifunction peripheral (MFP). The media to be conveyed may be, for example, printing material (e.g., paper sheets) instead of documents. In this case, the media conveying apparatus 100 may be, for example, a printer.

In FIG. 1, arrow A1 indicates a substantially vertical direction (height direction). Arrow A2 indicates the direction in which media are conveyed. Arrow A3 indicates the direction in which media are ejected. Arrow A4 indicates the width direction orthogonal to the media conveyance direction A2 or the media ejection direction A3. In the following description, the term "upstream" refers to "upstream" in the media conveyance direction A2 or the media ejection direction A3, whereas the term "downstream" refers to "downstream" in the media conveyance direction A2 or the media ejection direction A3.

The media conveying apparatus 100 includes a first housing 101, a second housing 102, a feed table 103, an ejection tray 105, an extension tray 106, an operation device 107, and a display device 108.

The second housing 102 is located inside the first housing 101 and is rotatably engaged with the first housing 101 with a hinge such that the second housing 102 can be opened and closed to, for example, remove a jammed medium or clean the inside of the media conveying apparatus 100.

The feed table 103 is engaged with the first housing 101 such that the media to be conveyed are placed on the feed table 103. The feed table 103 is movable in the height direction A1, that is, up and down, on a medium-supply side of the first housing 101. The medium-supply side of the first housing 101 is the side from which the media are supplied into the first housing 101. When no media are conveyed, the feed table 103 is positioned at a lower end in a movable range of the feed table 103 to facilitate the placement of media on the feed table 103. When media are conveyed, the feed table 103 is raised to a position at which the uppermost medium of the media on the feed table 103 contacts a pick roller described later. The feed table 103 includes a pullout tray 104 and is extendable in a direction opposite to the media conveyance direction A2. The pullout tray 104 may be omitted.

The pullout tray 104 can be pulled out from an upstream end portion of the feed table 103 in the media conveyance direction A2. When small-sized media (e.g., media of A5 or smaller size) are conveyed, the pullout tray 104 is stored inside the feed table 103. By contrast, when large-sized media (e.g., media of A5 or larger size) are conveyed, the pullout tray 104 is pulled out from the feed table 103 to extend the feed table 103. The pullout tray 104 cooperates with the feed table 103 to support the media placed thereon and conveyed thereafter.

The ejection tray 105 and the extension tray 106 are examples of trays. The ejection tray 105 is engaged with the second housing 102 to stack the media ejected from an ejection port of the first housing 101 and the second housing 102. The ejection tray 105 is located above the feed table 103 to face the feed table 103, that is, to overlap the feed table 103 when viewed in the height direction A1. The ejection tray 105 has side guides 105*a*. The side guides 105*a* are located on an upper face of the ejection tray 105 in a movable manner in the width direction A4. The side guides 105*a* are positioned to fit the width of the media stacked on the ejection tray 105 and regulate the width direction of the media. In FIG. 1, for example, the two side guides 105*a* are positioned at an interval in the width direction A4. The number of side guides 105*a* is not limited to two or more but may be one.

The extension tray 106 is coupled to a downstream end of the ejection tray 105 in the media ejection direction A3. The extension tray 106 is rotatable at the downstream end of the ejection tray 105 in the media ejection direction A3. When a small-sized medium (e.g., a medium of A5 or smaller size) is ejected, the extension tray 106 is closed and placed (stored) on the ejection tray 105. By contrast, when a large-sized medium (e.g., a medium of a size larger than A5) is ejected, the extension tray 106 is opened to extend downstream in the media ejection direction A3 from the ejection tray 105. In other words, similarly with the ejection tray 105, the extension tray 106 is located above the feed table 103 to face the feed table 103, that is, to overlap the feed table 103 when viewed in the height direction A1. The extension tray 106 cooperates with the ejection tray 105 to receive the media ejected from the ejection port of the first housing 101 and the second housing 102.

The operation device 107 includes an input device such as keys and an interface circuit that acquires signals from the input device. The operation device 107 receives an input operation performed by the user and outputs an operation signal corresponding to the input operation performed by the user. The display device 108 includes a display and an interface circuit that outputs image data to the display, to display the image data on the display. Examples of the display include, but are not limited to, a liquid crystal and an organic electro-luminescence (EL). The display device 108 may be a liquid crystal display with a touch panel function. In this case, the operation device 107 includes an interface circuit that acquires input signals from the touch panel.

Figure 2:
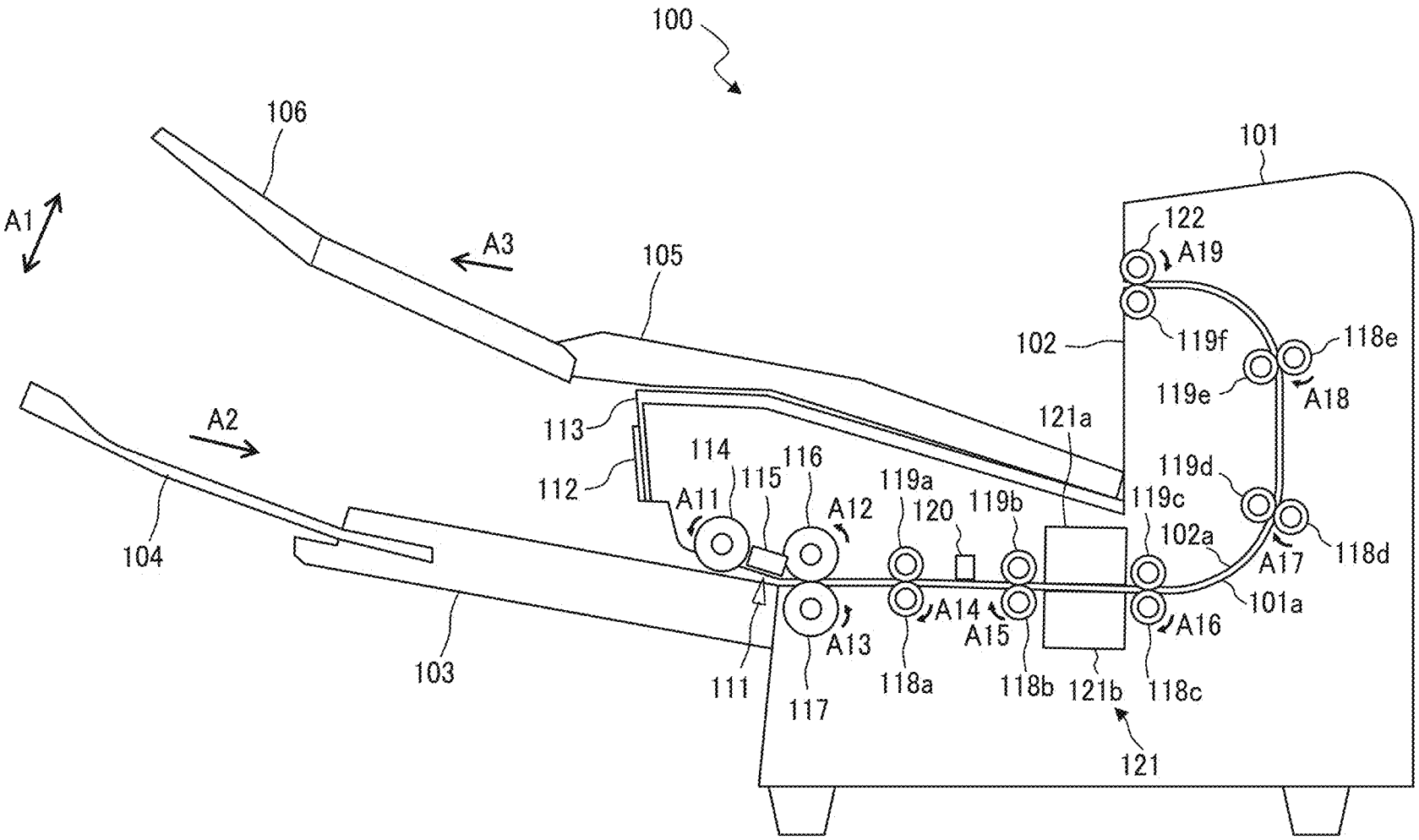
FIG. 2 is a diagram illustrating a conveyance passage inside the media conveying apparatus of FIG. 1.

FIG. 2 is a diagram illustrating a conveyance passage inside the media conveying apparatus 100.

The conveyance passage inside the media conveying apparatus 100 includes a first media sensor 111, a first floating sensor 112, a guide 113, a pick roller 114, a second floating sensor 115, a feed roller 116, a separation roller 117, a first conveyance roller 118*a*, a second conveyance roller 118*b*, a third conveyance roller 118*c*, a fourth conveyance roller 118*d*, a fifth conveyance roller 118*e*, a first driven roller 119*a*, a second driven roller 119*b*, a third driven roller 119*c*, a fourth driven roller 119*d*, a fifth driven roller 119*e*, a sixth driven roller 119*f*, a second media sensor 120, an imaging device 121, and an ejection roller 122.

The number of each of the pick roller 114, the feed roller 116, the separation roller 117, the first conveyance roller 118*a*, the second conveyance roller 118*b*, the third conveyance roller 118*c*, the fourth conveyance roller 118*d*, the fifth conveyance roller 118*e*, the first driven roller 119*a*, the second driven roller 119*b*, the third driven roller 119*c*, the fourth driven roller 119*d*, the fifth driven roller 119*e*, the sixth driven roller 119*f*, and/or the ejection roller 122 is not limited to one but may be two or more. When the number is two or more, feed rollers 116 are aligned with and spaced apart from each other in the width direction A4. In the same manner, separation rollers 117, first conveyance rollers 118*a*, second conveyance rollers 118*b*, third conveyance roller 118*c*, fourth conveyance rollers 118*d*, fifth conveyance rollers 118*e*, first driven rollers 119*a*, second driven rollers 119*b*, third driven rollers 119*c*, fourth driven rollers 119*d*, fifth driven rollers 119*e*, sixth driven rollers 119*f*, and/or ejection rollers 122 are also aligned with and spaced apart from each other in the width direction A4.

The first housing 101 has a face facing the second housing 102 to form a first guide 101*a* of the media conveyance passage. The second housing 102 has a face facing the first housing 101 to form a second guide 102*a* of the media conveyance passage. The first guide 101*a* and the second guide 102*a* define a so-called U-turn path.

The first media sensor 111 is an example of a first sensor. The first media sensor 111 is located on the feed table 103, that is, upstream from the feed roller 116 and the separation roller 117 to detect a medium on the feed table 103. The first media sensor 111 determines whether a medium is placed on the feed table 103 using a contact sensor that allows a predetermined amount of electrical current to flow when a medium is in contact with the contact sensor or no medium is in contact with the contact sensor. The first media sensor 111 generates and outputs a first media signal whose signal value changes depending on whether a medium is present on the feed table 103. The first media signal is an example of an output signal from the first media sensor 111. The first media sensor 111 is not limited to the contact sensor. The first media sensor 111 may be any other sensor that can detect the presence of a medium such as an optical sensor.

The pick roller 114 is located in the second housing 102. The pick roller 114 contacts the medium on the feed table 103 that is raised to substantially the same height as the height of the media conveyance passage and feeds the medium downstream in the media conveyance passage.

The feed roller 116 is located downstream from the pick roller 114 in the second housing 102 and feeds the medium fed from the feed table 103 by the pick roller 114 further downstream in the media conveyance passage. The separation roller 117 faces the feed roller 116 in the first housing 101. The separation roller 117 is a so-called brake roller or retard roller. The separation roller 117 is stoppable or rotatable in a direction opposite to a media feeding direction in which media are fed. The feed roller 116 and the separation roller 117 perform the above-described operation to separate the media and feed the media one by one. The feed roller 116 is located above the separation roller 117. With this configuration, the media conveying apparatus 100 feeds media from the top by a so-called top-sheet feeding method. A separation pad may be used instead of the separation roller 117.

The first to fifth conveyance rollers 118*a* to 118*e* and the first to fifth driven rollers 119*a* to 119*e* face each other at positions downstream from the feed roller 116 and the separation roller 117 to convey the medium fed by the feed roller 116 and the separation roller 117 downstream in the media conveyance passage.

The second media sensor 120 is located downstream from the first conveyance roller 118*a* and the first driven roller 119*a* and upstream from the second conveyance roller 118*b* and the second driven roller 119*b* in the media conveyance direction A2. The second media sensor 120 detects the medium conveyed to the position of the second media sensor 120. The second media sensor 120 may be located between a pair of the feed roller 116 and the separation roller 117 and a pair of the first conveyance roller 118*a* and the first driven roller 119*a* or between the imaging device 121 and a pair of the second conveyance roller 118*b* and the second driven roller 119*b*. The second media sensor 120 includes a light emitter, a light receiver, and a light guide tube. The light emitter and the light receiver are located on one side of the media conveyance passage. The light guide tube faces the light emitter and the light receiver across the media conveyance passage. The light emitter is, for example, a light emitting diode (LED) and emits light toward the media conveyance passage. On the other hand, the light receiver is, for example, a photodiode and receives light that is emitted by the light emitter and guided by the light guide tube. Based on the intensity of the light received by the light receiver, the second media sensor 120 generates and outputs a third media signal whose signal value changes between when a medium is present at the position of the second media sensor 120 and when a medium is absent at the position of the second media sensor 120.

A reflector such as a mirror may be used instead of the light guide tube. The light emitter and the light receiver may face each other across the media conveyance passage. The second media sensor 120 may be any other sensor that can detect the presence of a medium, such as a contact sensor that allows a predetermined amount of electrical current to flow when a medium is in contact with the contact sensor or no medium is in contact with the contact sensor.

The imaging device 121 is located downstream from the first and second conveyance rollers 118*a* and 118*b* in the media conveyance direction A2 to image the medium conveyed by the first and second conveyance rollers 118*a* and 118*b* and the first and second driven rollers 119*a* and 119*b*. The imaging device 121 includes a first imaging device 121*a* and a second imaging device 121*b* facing each other across the media conveyance passage.

The first imaging device 121*a* includes, as a line sensor, a contact image sensor (CIS) employing an equal-magnification optical system and including, as imaging elements, complementary metal oxide semiconductors (CMOSs) aligned linearly in the main-scanning direction. The first imaging device 121*a* further includes a lens and an analog-to-digital (A/D) converter. The lens forms an image on the imaging elements. The A/D converter amplifies the electrical signals output from the imaging elements and performs analog-to-digital (A/D) conversion. The first imaging device 121*a* images the front side of the medium being conveyed, generates an input image, and outputs the input image.

Similarly, the second imaging device 121*b* includes, as a line sensor, a CIS employing the equal-magnification optical system and including, as imaging elements, CMOSs aligned linearly in the main-scanning direction. The second imaging device 121*b* further includes a lens and an analog-to-digital (A/D) converter. The lens forms an image on the imaging elements. The A/D converter amplifies the electrical signals output from the imaging elements and performs analog-to-digital (A/D) conversion. The second imaging device 121*b* images the back side of the medium being conveyed, generates an input image, and outputs the input image.

Alternatively, the media conveying apparatus 100 may include either the first imaging device 121*a* or the second imaging device 121*b* to read only one side of the medium. The line sensor may be, instead of the CIS employing the equal-magnification optical system and including CMOSs as imaging elements, a CIS employing the equal-magnification optical system and including charge-coupled devices (CCDs) as imaging elements. Alternatively, a line sensor employing a reduction optical system and including, as imaging elements, CMOSs or CCDs may be used.

The ejection roller 122 and the sixth driven roller 119*f* face each other at a position downstream from the first to fifth conveyance rollers 118*a* to 118*e*. The ejection roller 122 and the sixth driven roller 119*f* eject the medium conveyed by the first to fifth conveyance rollers 118*a* to 118*e* and the first to fifth driven rollers 119*a* to 119*e* onto the ejection tray 105 and the extension tray 106.

As the pick roller 114 and the feed roller 116 rotate in media feeding directions A11 and A12, respectively, the medium is conveyed from the feed table 103 in the media conveyance direction A2 between the first guide 101*a* and the second guide 102*a*. The media conveying apparatus 100 has two feeding modes: a separation mode in which media are fed while being separated and a non-separation mode in which media are fed without being separated. The feeding mode is set by the user using the operation device 107 or an information processing device connected to the media conveying apparatus 100 for communication. When the feeding mode is set to the separation mode, the separation roller 117 stops or rotates in the direction indicated by arrow A13 opposite to the media feeding direction. This operation prevents the feeding of a medium other than the separated medium. In short, multiple feeding is prevented. By contrast, when the feeding mode is set to the non-separation mode, the separation roller 117 rotates in the media feeding direction opposite to the direction indicated by arrow A13.

As the first and second conveyance rollers 118*a* and 118*b* rotate in the directions indicated by arrows A14 and A15, respectively, the medium is fed to the imaging position in the imaging device 121 while being guided by the first guide 101*a* and the second guide 102*a*. At the imaging position, the imaging device 121 images the medium. As the third conveyance roller 118*c*, the fourth conveyance roller 118*d*, the fifth conveyance roller 118*e*, and the ejection roller 122 rotate in the directions indicated by arrows A16, A17, A18, and A19, respectively, the medium is ejected onto the ejection tray 105 and the extension tray 106. The ejection tray 105 and the extension tray 106 stack the media ejected by the ejection roller 122 and the sixth driven roller 119*f*.

The pick roller 114, the feed roller 116, the separation roller 117, the first to fifth conveyance rollers 118*a* to 118*e*, and/or the first to sixth driven rollers 119*a* to 119*f* are examples of conveyors and convey a medium placed on the feed table 103. The ejection roller 122 and/or the sixth driven roller 119*f* are examples of ejectors and eject the medium conveyed by the conveyors.

Figure 3:
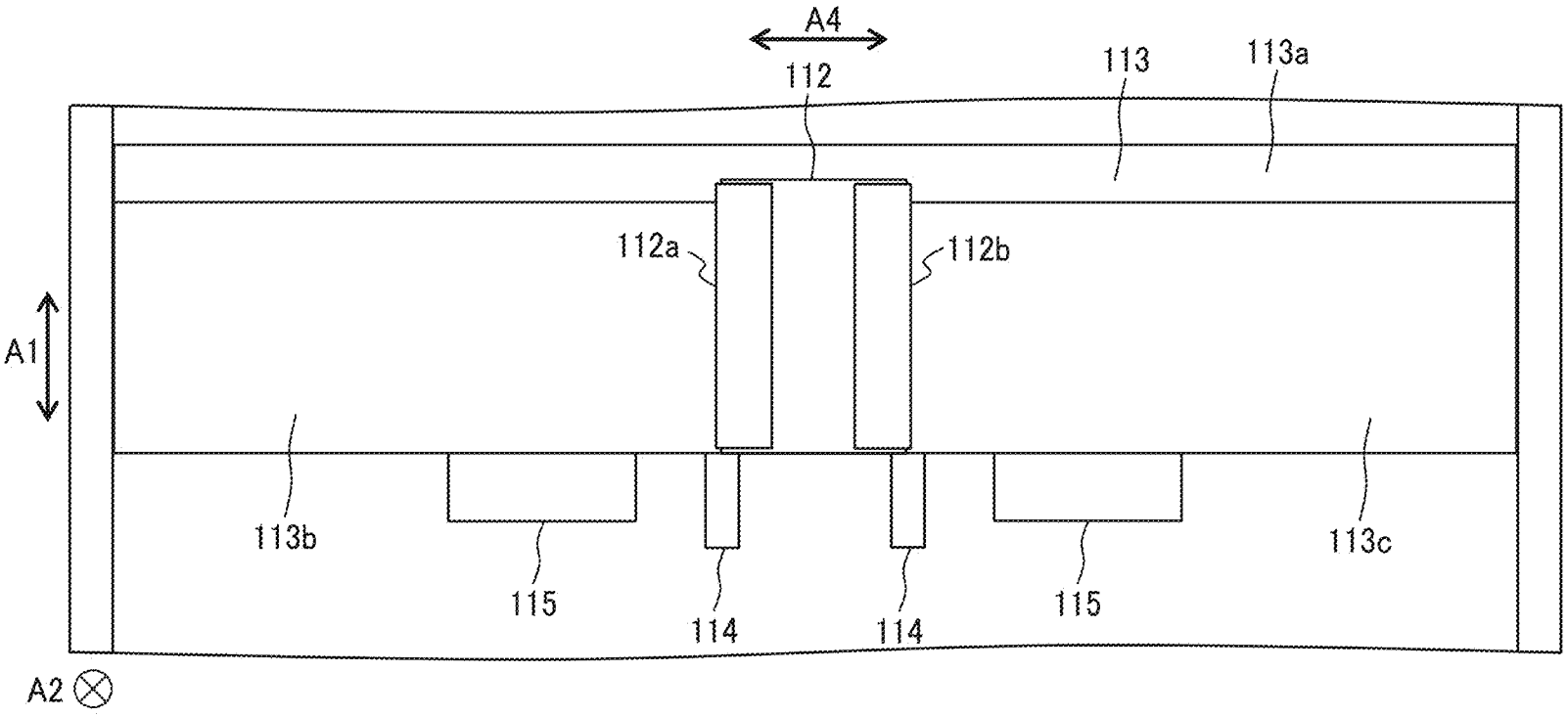
FIG. 3 is a schematic diagram illustrating a first floating sensor, a guide member, and a second floating sensor.

FIG. 3 is a schematic diagram illustrating the first floating sensor 112, the guide 113, and the second floating sensor 115. FIG. 3 is a schematic view of the first floating sensor 112, the guide 113, and the second floating sensor 115 viewed from upstream in the media conveyance direction A2. The example illustrated in FIG. 3, two pick rollers 114 are aligned with and spaced apart from each other in the width direction A4, and two second floating sensors 115 are aligned and spaced apart from each other in the width direction A4.

The first floating sensor 112 is an example of a sensor. The first floating sensor 112 detects the floating of a medium conveyed by the conveyors. As illustrated in FIG. 2, the first floating sensor 112 is located at an upstream end of the second housing 102, that is, at a position upstream from the pick roller 114 and the feed roller 116 in the media conveyance direction A2. As illustrated in FIGS. 2 and 3, the first floating sensor 112 is located above the feed table 103 and the pick roller 114 and below the ejection tray 105 and the extension tray 106 in the height direction A1. As illustrated in FIG. 3, the first floating sensor 112 is located at substantially the center of the media conveyance passage in the width direction A4. The first floating sensor 112 is located, for example, inside the outer ends of the pick rollers 114 in the width direction A4.

If a portion of the medium conveyed by the conveyors floats, the guide 113 guides the floating portion of the medium to the first floating sensor 112. As illustrated in FIG. 2, the guide 113 is located such that the guide 113 covers a part of the second housing 102, and functions as a cover of the second housing 102. The guide 113 is located at the upstream end of the second housing 102, that is, at a position upstream from the pick roller 114 and the feed roller 116 in the media conveyance direction A2. As illustrated in FIG. 3, the guide 113 is located around the first floating sensor 112 such that the guide 113 surrounds the first floating sensor 112. In other words, at least part of the guide 113 is located above and below the first floating sensor 112 in the height direction A1, and at least part of the guide 113 is located outside the first floating sensor 112 in the width direction A4. With such a configuration, the guide 113 is located such that if a portion of the medium conveyed by the conveyors float, the floating portion of the medium can be guided to the first floating sensor 112.

The guide 113 includes, for example, a first guide face 113*a*, a second guide face 113*b*, and a third guide face 113*c*. The first guide face 113*a*, the second guide face 113*b*, and the third guide face 113*c* are located such that each of the first guide face 113*a*, the second guide face 113*b*, and the third guide face 113*c* faces upstream in the media conveyance direction A2. The first guide face 113*a*, the second guide face 113*b*, and the third guide face 113*c* are formed flat such that the first guide face 113*a*, the second guide face 113*b*, and the third guide face 113*c* have no step, that is, no projecting part projecting upstream in the media conveyance direction A2. In particular, the first guide face 113*a*, the second guide face 113*b*, and the third guide face 113*c* are formed such that any position in the first guide face 113*a*, the second guide face 113*b*, and the third guide face 113*c* has no projecting part projecting more upstream in the media conveyance direction A2 than a position that is farther from the first floating sensor 112 than any position itself.

The first guide face 113*a* is located above the first floating sensor 112 in the height direction A1. When a rear end of the medium conveyed by the conveyors floats and comes into contact with the first guide face 113*a*, the first guide face 113*a* guides the rear end of the medium downward to the first floating sensor 112.

The second guide face 113*b* is located to the left of the first floating sensor 112 in the width direction A4 when viewed from upstream in the media conveyance direction A2. When a part of the medium conveyed by the conveyors floats and comes into contact with the second guide face 113*b*, the second guide face 113*b* guides the contacted part of the medium toward the first floating sensor 112.

The third guide face 113*c* is located to the right of the first floating sensor 112 in the width direction A4 when viewed from upstream in the media conveyance direction A2. When a part of the medium conveyed by the conveyors floats and comes into contact with the third guide face 113*c*, the third guide face 113*c* guides the contacted part of the medium toward the center of the first floating sensor 112.

It is preferable that the first guide face 113*a*, the second guide face 113*b*, and the third guide face 113*c* are located downstream from the first floating sensor 112 in the media conveyance direction A2. With such a configuration, the medium guided by the first guide face 113*a*, the second guide face 113*b*, or the third guide face 113*c* more reliably comes into contact with the first floating sensor 112.

The first guide face 113*a*, the second guide face 113*b*, and the third guide face 113*c* may be formed flush and the guide 113 may be formed flat with no step as a whole.

The second floating sensor 115 detects floating of the medium conveyed by the conveyors. As illustrated in FIG. 2, the second floating sensor 115 is located downstream from the pick roller 114 and upstream from the feed roller 116 in the media conveyance direction A2. As illustrated in FIGS. 2 and 3, a lower end of the second floating sensor 115 is located above a lower end (nipping position) of the pick roller 114 and a lower end (nipping position) of the feed roller 116 in the height direction A1. As illustrated in FIG. 3, the second floating sensors 115 are located outside the first floating sensor 112 in the width direction A4. The second floating sensors 115 are located, e.g., outside the outer ends of the pick rollers 114 in the width direction A4. The second floating sensors 115 may be located at a central part in the width direction A4, e.g., between the outer ends of the two pick rollers 114. The number of second floating sensors 115 is not limited to two but may be one, or three or more.

Figure 4A:
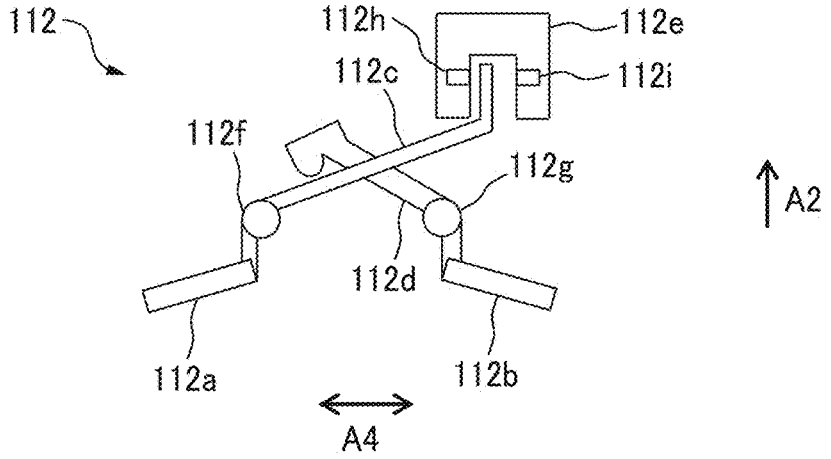
FIGS. 4A, 4B, and 4C are schematic diagrams illustrating the first floating sensor of FIG. 3.
Figure 4B:
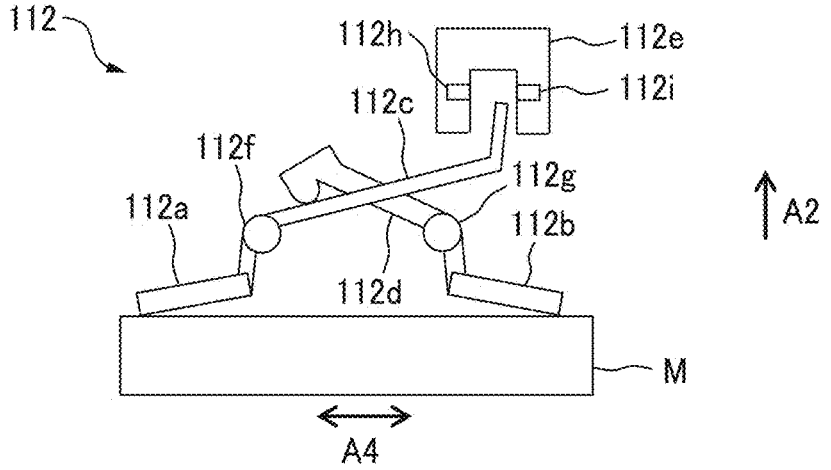
Figure 4C:
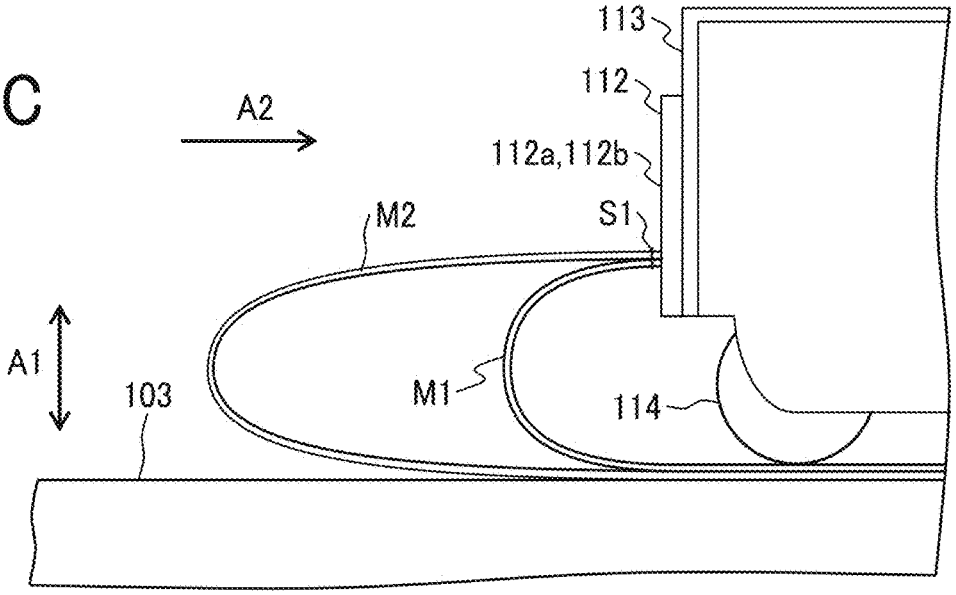

FIGS. 4A, 4B, and 4C are schematic diagrams illustrating the first floating sensor 112.

The first floating sensor 112 includes a first contact member 112*a*, a second contact member 112*b*, a first arm 112*c*, a second arm 112*d*, and a horseshoe-shaped sensor 112*e* as illustrated in FIG. 4A. The first contact member 112*a* and the second contact member 112*b* are located at an upstream end of the first housing 101 in the media conveyance direction A2, and aligned with and spaced apart from each other in the width direction A4. The first contact member 112*a* and the second contact member 112*b* are, for example, resin members, and are located substantially orthogonal to the media conveyance direction A2. One end of the first arm 112*c* is attached to the first contact member 112*a*. One end of the second arm 112*d* is attached to the second contact member 112*b*. The first arm 112*c* and the second arm 112*d* are swingable about a first swing shaft 112*f* and a second swing shaft 112*g*, respectively. The other end of the first arm 112*c* is located inside the horseshoe-shaped sensor 112*e*. The other end of the second arm 112*d* is located to be able to come into contact with and move away from the first arm 112*c*.

The horseshoe-shaped sensor 112*e* includes a light emitter 112*h* and a light receiver 112*i*. The light emitter 112*h* and the light receiver 112*i* are located facing each other. The light emitter 112*h* is, for example, an LED and emits light toward the light receiver 112*i*. The light receiver 112*i* is, for example, a photodiode and receives the light emitted by the light emitter 112*h*.

As illustrated in FIG. 4, when a medium does not contact the first contact member 112*a* and the second contact member 112*b*, the other end of the first arm 112*c* is placed between the light emitter 112*h* and the light receiver 112*i*, and the light emitted by the light emitter 112*h* is blocked by the first arm 112*c*. On the other hand, as illustrated in FIG. 4B, when the medium contacts the first contact member 112*a*, the other end of the first arm 112*c* moves from a position between the light emitter 112*h* and the light receiver 112*i*, and the light emitted by the light emitter 112*h* is received by the light receiver 112*i*. When the medium comes into contact with the second contact member 112*b*, the second arm 112*d* comes into contact with the first arm 112*c* and the first arm 112*c* moves with the second arm 112*d*. In this case, the other end of the first arm 112*c* also moves from the position between the light emitter 112*h* and the light receiver 112*i*, and the light emitted by the light emitter 112*h* is received by the light receiver 112*i*. The horseshoe-shaped sensor 112*e* generates and outputs a first floating signal based on the intensity of the light received by the light receiver 112*i*. The first floating signal varies in signal value depending on whether a medium contacts the first contact member 112*a* or the second contact member 112*b*.

In the first floating sensor 112, the first contact member 112*a* and the second contact member 112*b* are aligned with and spaced apart from each other in the width direction A4, and the movement of each of the first contact member 112*a* and the second contact member 112*b* is detected by the horseshoe-shaped sensor 112*e*. Due to such a configuration, the media conveying apparatus 100 can efficiently and inexpensively detect that the medium comes into contact with the first floating sensor 112. In the first floating sensor 112, the number of contact members is not limited to two but may be one or three or more. In the first floating sensor 112, horseshoe-shaped sensors may be provided for contact members in one-to-one correspondence.

FIG. 4C is a schematic diagram illustrating the movement of the first floating sensor 112 when the rear end of the medium conveyed floats.

FIG. 4C illustrates a state in which multiple media M1 and M2 whose rear ends are bound with staples S1 at multiple positions are conveyed. When the media M1 and M2 whose rear end is bound with the staples S1 at multiple positions are conveyed, the uppermost medium M1 is fed by the feed roller 116 and the other medium M2 stays on the feed table 103 by the separation roller 117. Accordingly, a part bound with the staples S1 is pulled by the uppermost medium M1 and floats upward to contact a front surface of the first contact member 112*a* or the second contact member 112*b*.

When multiple media whose rear ends are bound with a staple at one corner are conveyed, likewise, the uppermost medium is similarly fed by the feed roller 116 and the other medium stays on the feed table 103 by the action of the separation roller 117. Accordingly, a part bound with the staple is pulled by the upper most medium and floats upward to contact the front surface of the first contact member 112*a* or the second contact member 112*b*.

As illustrated in FIG. 4A, when the medium does not contact the first contact member 112*a* and the second contact member 112*b*, the light emitted by the light emitter 112*h* is blocked by the first arm 112*c*. On the other hand, as illustrated in FIG. 4B, when the rear end of the medium conveyed floats and contacts the front surface of the first contact member 112*a* or the second contact member 112*b*, the first contact member 112*a* or the second contact member 112*b* is pushed by the rear end of the medium. In this case, the light emitted by the light emitter 112*h* is received by the light receiver 112*i* without being blocked by the first arm 112*c*. In other words, the signal value of the first floating signal generated by the first floating sensor 112 varies depending on whether the medium conveyed is floating, and the first floating sensor 112 detects floating of the medium conveyed by the conveyors. In particular, the first floating sensor 112 can detect the media whose rear ends are bound with the staple.

Figure 5:
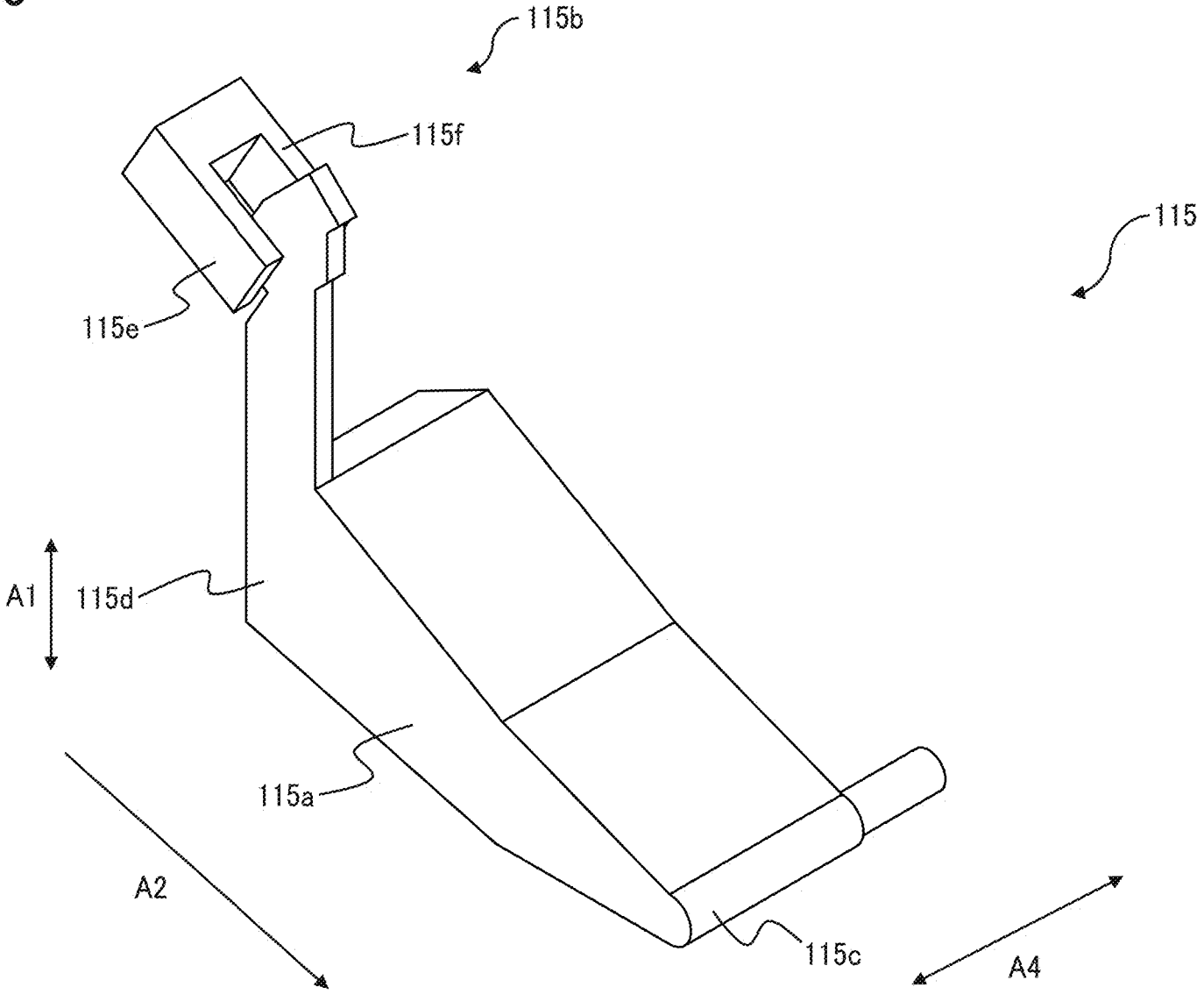
FIG. 5 is a perspective view of the second floating sensor of FIG. 3.

FIG. 5 is a perspective view of the second floating sensor 115.

The second floating sensor 115 has an arm 115*a* and a horseshoe-shaped sensor 115*b*.

The arm 115*a* is located on the upper side of the media conveyance passage so as to extend in the media conveyance direction A2, and is located so that the lower surface of the arm 115*a* faces the first guide 101*a* with a predetermined distance away from the first guide 101*a*. When a plurality of second floating sensors 115 are provided, the respective arms 115*a* are arranged at the same height in the height direction A1. A downstream end 115*c* of the arm 115*a* is rotatably attached to the second housing 102 such that an upstream end 115*d* of the arm 115*a* swings. The predetermined distance is set to a distance obtained by adding a margin to a maximum height at which the medium can be deflected during feeding of the medium. Thus, when the medium to be conveyed does not float, the medium is conveyed without contacting the arm 115*a*. On the other hand, when the medium to be conveyed floats, the medium comes into contact with the arm 115*a* to rotate the arm 115*a*. Thus, the arm 115*a* is raised. In other words, the arm 115*a* is raised in response to the floating of the medium.

The horseshoe-shaped sensor 115*b* includes a light emitter 115*e* and a light receiver 115*f*. The light emitter 115*e* and the light receiver 115*f* are arranged to face each other. The light emitter 115*e* is, for example, an LED and emits light toward the light receiver 115*f*. The light receiver 115*f* is, for example, a photodiode and receives the light emitted by the light emitter 115*e*.

When no medium is in contact with the arm 115*a*, the arm 115*a* is placed between the light emitter 115*e* and the light receiver 115*f*, and the light emitted by the light emitter 115*e* is blocked by the arm 115*a*. On the other hand, when a medium comes into contact with the arm 115*a* and the arm 115*a* is raised, the arm 115*a* moves from a position between the light emitter 115*e* and the light receiver 115*f*, and the light emitted by the light emitter 115*e* is received by the light receiver 115*f*. The horseshoe-shaped sensor 115*b* generates and outputs a second floating signal based on the intensity of the light received by the light receiver 115*f*. The second floating signal varies in signal value depending on whether the arm 115*a* is raised by the medium.

When multiple media whose leading ends (downstream ends) are bound with a staple at one corner are conveyed, the feed roller 116 feeds the uppermost medium whereas the separation roller 117 causes the other medium to stay on the feed table 103. Accordingly, a surrounding portion of the stapled position of the medium floats to a position where the surrounding portion contacts the arm 115*a*. The signal value of the second floating signal generated by the second floating sensor 115 varies depending on whether the medium conveyed is floating, and the second floating sensor 115 detects floating of the medium conveyed by the conveyors. In particular, the second floating sensor 115 can detect media whose leading ends are stapled.

Figure 6A:
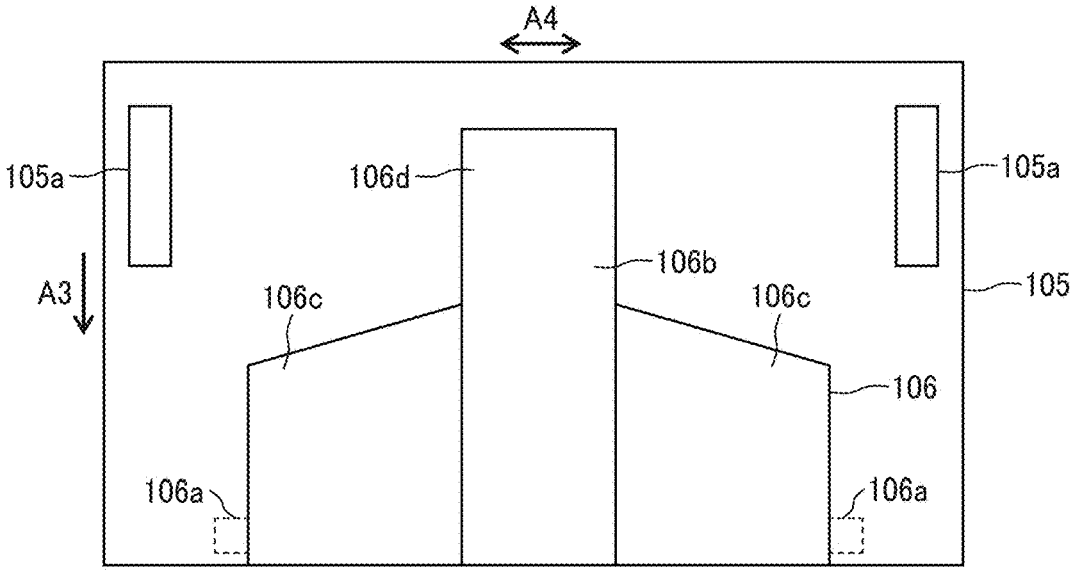
FIGS. 6A and 6B are schematic diagrams illustrating an extension tray and an ejection tray.
Figure 6B:
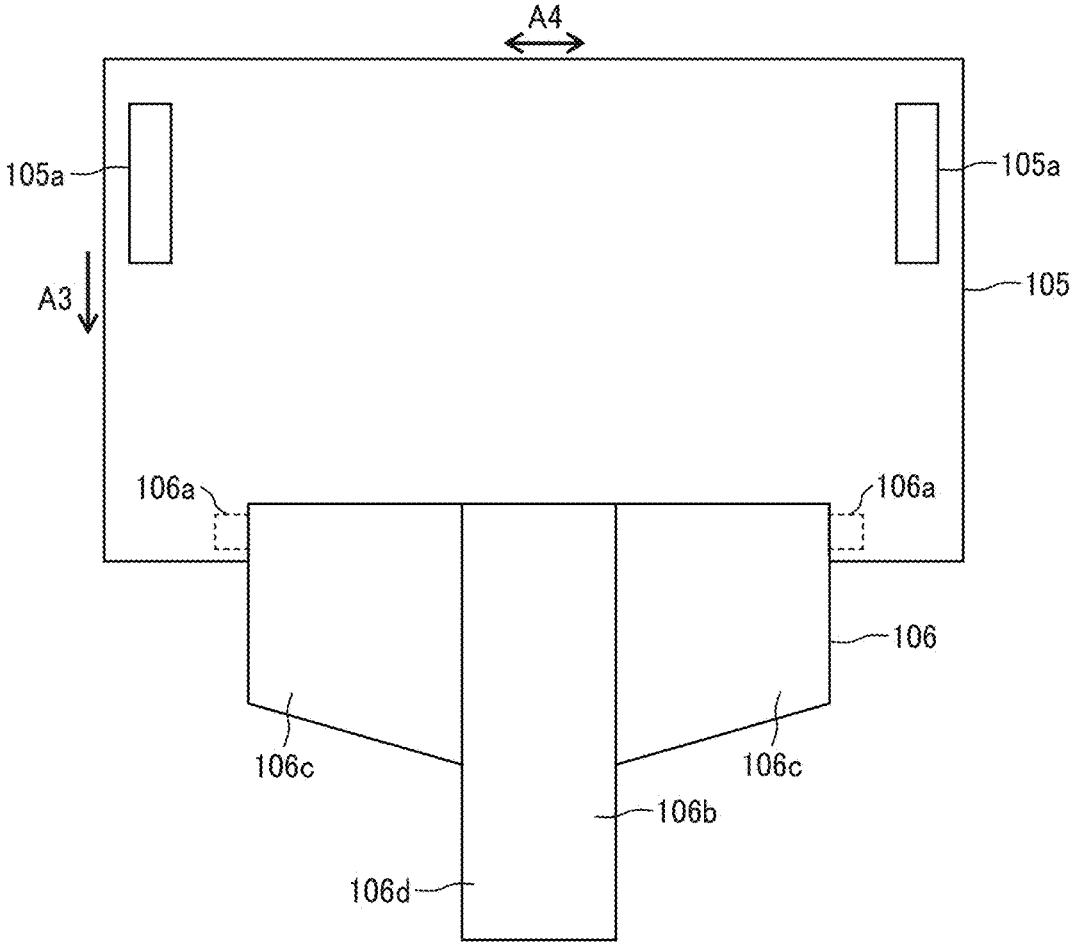

FIGS. 6A and 6B are schematic views of the ejection tray 105 and the extension tray 106. FIGS. 6A and 6B are schematic views of the ejection tray 105 and the extension tray 106 viewed from above. FIG. 6A illustrates the extension tray 106 in a closed state. FIG. 6B illustrates the extension tray 106 in an open state.

As illustrated in FIGS. 6A and 6B, the extension tray 106 rotates around a rotation shaft 106*a* and can be opened and closed with respect to the ejection tray 105. As illustrated in FIG. 6A, the extension tray 106 is stored on the ejection tray 105 in the closed state. On the other hand, as illustrated in FIG. 6B, the extension tray 106 is placed in the open state to extend the ejection tray 105, and stacks media ejected from the ejector in cooperation with the ejection tray 105. With such a configuration, the extension tray 106 of the media conveying apparatus 100 can be opened and closed according to the size of the medium to be ejected. When small-sized media are ejected, the extension tray 106 is closed to reduce the entire size of the media conveying apparatus 100. Thus, the media conveying apparatus 100 can secure a workspace for the user. By contrast, when large-sized media are ejected, the extension tray 106 is opened. Thus, the media conveying apparatus 100 can stably stack the ejected media on the ejection tray 105 and the extension tray 106.

The extension tray 106 has a base 106*b* and attachments 106*c*. In the width direction A4, the base 106*b* is located in a central part of the extension tray 106, and the attachments 106*c* are coupled to (located on) the left and right sides of the base 106*b*. The attachment 106*c* may be coupled to (located on) only one of the left and right sides of the base 106*b*.

The attachment 106*c* is shorter than the base 106*b* in the media ejection direction A3. The base 106*b* has a projection 106*d* that projects more downstream in the media ejection direction A3 than the attachments 106*c* when the extension tray 106 is opened. In other words, when the extension tray 106 is closed, the base 106*b* and the attachments 106*c* are present in a downstream portion of the extension tray 106, but only the base 106*b* is present in an upstream portion of the extension tray 106. Therefore, when the extension tray 106 is closed, the length of the upstream portion of the extension tray 106 in the width direction A4 is shorter than the length of the downstream portion of the extension tray 106 in the width direction A4. Thus, even when the side guide 105*a* is located on the center side in the width direction A4, the side guide 105*a* does not interfere with the extension tray 106. Accordingly, when the extension tray 106 is opened and closed in the state where the side guide 105*a* is located on the center side in the width direction A4, the extension tray 106 is prevented from colliding with and being damaged by the side guide 105*a*.

Figure 7:
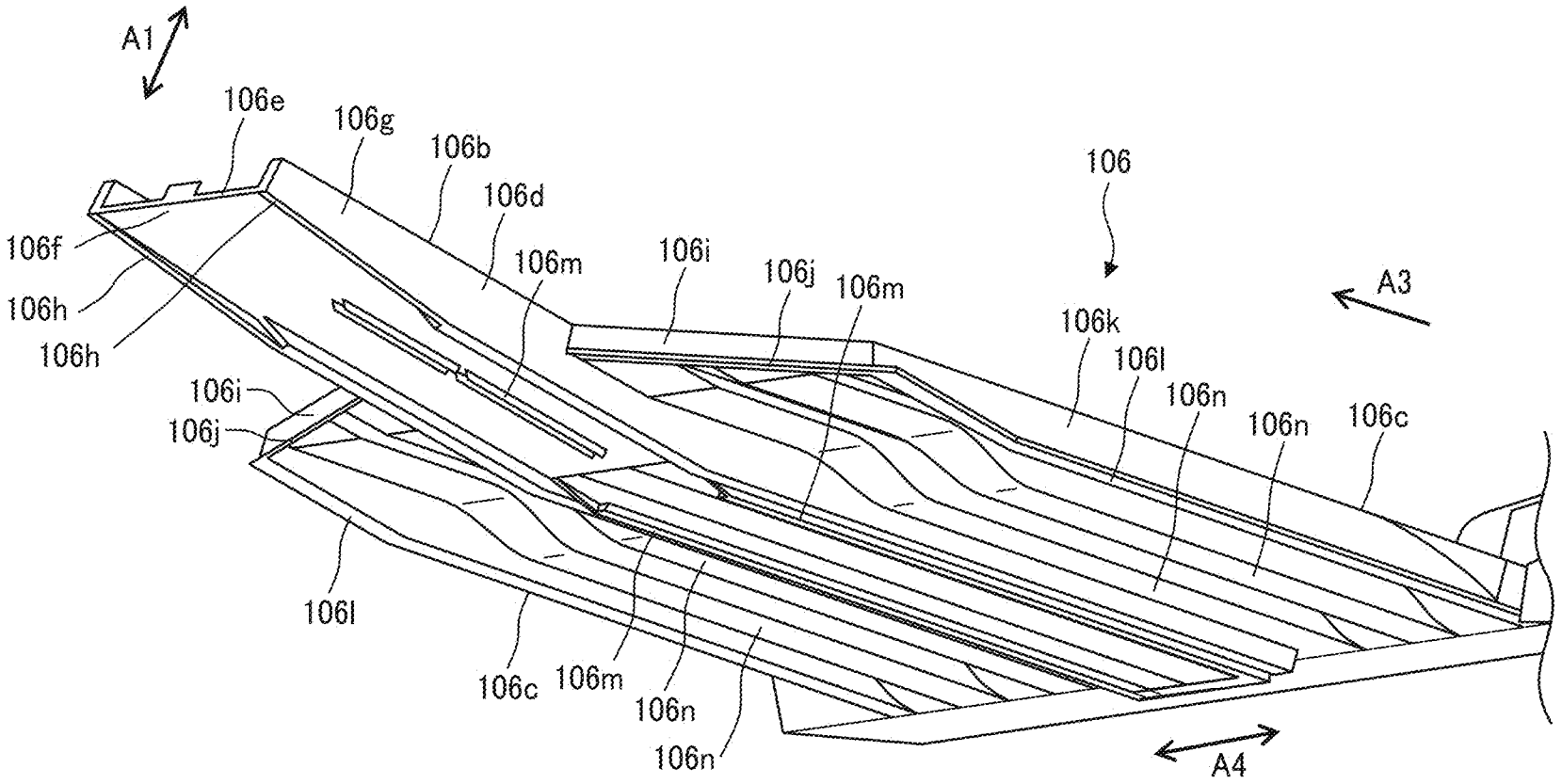
FIG. 7 is a schematic diagram illustrating the extension tray of FIGS. 6A and 6B.
Figure 8:
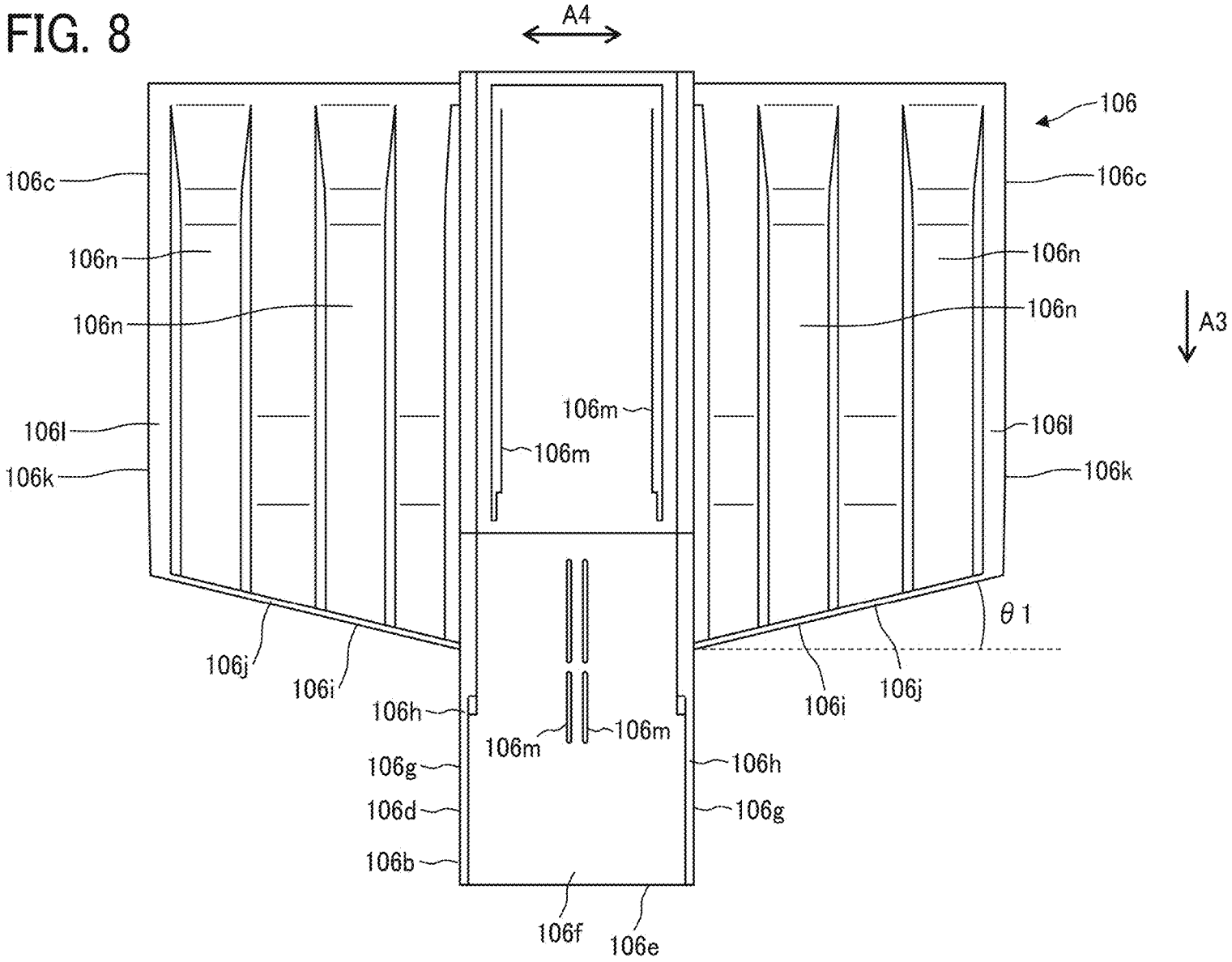
FIG. 8 is a schematic diagram illustrating the extension tray of FIGS. 6A and 6B.
Figure 9:
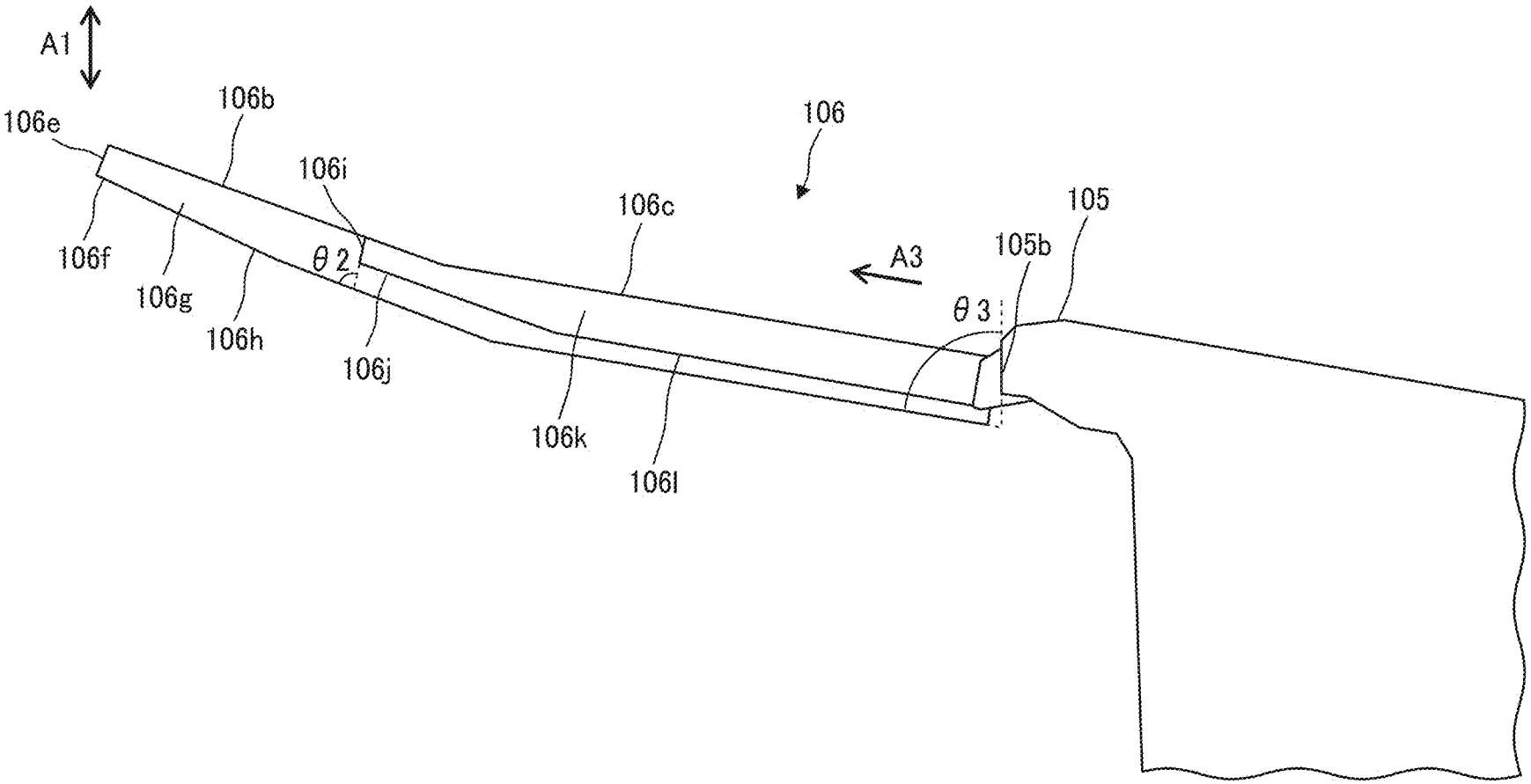
FIG. 9 is a schematic diagram illustrating the extension tray and the ejection tray of FIGS. 6A and 6B.
Figure 10A:
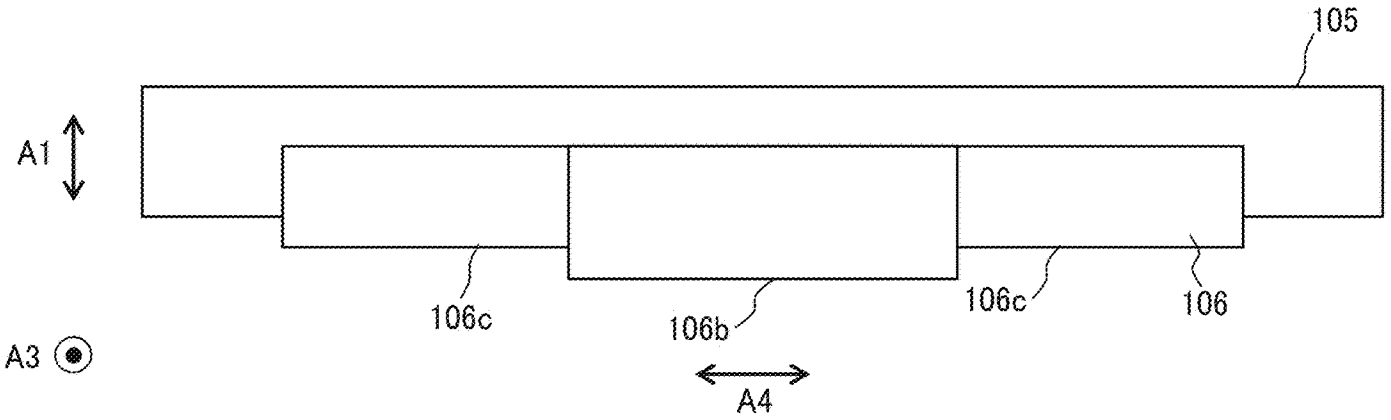
FIGS. 10A and 10B are schematic diagrams illustrating the extension tray and the ejection tray of FIGS. 6A and 6B.
Figure 10B:
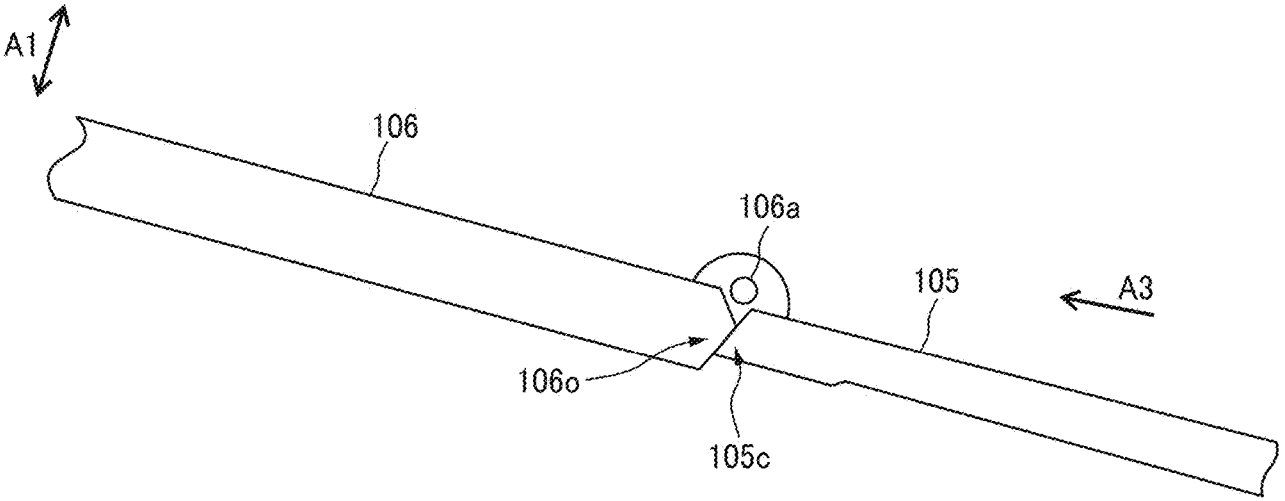

FIGS. 7, 8, 9, 10A, and 10B are perspective views of the ejection tray 105 and the extension tray 106. FIG. 7 is a schematic view of the extension tray 106 detached from the ejection tray 105, as viewed from below and downstream in the media ejection direction A3. FIG. 8 is a schematic view of the lower surface of the extension tray 106 detached from the ejection tray 105, as viewed from below. FIG. 9 is a schematic view of the ejection tray 105 and the extension tray 106 viewed from a lateral side thereof. FIG. 10A is a schematic view of the ejection tray 105 and the extension tray 106 viewed from downstream in the media ejection direction A3. FIG. 10B is a schematic view of the ejection tray 105 and the extension tray 106 viewed from a lateral side thereof.

As illustrated in FIGS. 7, 9, and 10A, at each position in the media ejection direction A3, the lower end of the base 106*b* is placed below the lower end of the attachment 106*c*, that is, at a position closer to the feed table 103 than the lower end of the attachment 106*c*. As illustrated in FIGS. 10A and 10B, the length of the extension tray 106 in the width direction A4 is shorter than the length of the ejection tray 105 in the width direction A4, and the lower end of the extension tray 106 is located below the ejection tray 105 with respect to the extending direction of the ejection tray 105, that is, at a position closer to the feed table 103 than the ejection tray 105.

As illustrated in FIGS. 7 and 8, a downstream end portion 106*e*, which is an end surface of a downstream end of the projection 106*d* of the base 106*b* in the media ejection direction A3, is formed flat such that the downstream end portion 106*e* has no step, that is, no projecting part projecting downstream in the media ejection direction A3. A lower end portion 106*f*, which is a lower surface of the downstream end of the projection 106*d* of the base 106*b* in the media ejection direction A3, is formed flat such that the lower end portion 106*f* has no step, that is, no projecting part projecting downward.

A side end portion 106*g*, which is a side surface of each of the left and right (outer) ends of the projection 106*d* of the base 106*b* in the width direction A4, is formed flat such that the side end portion 106*g* has no step, that is, no projecting part projecting outward in the width direction A4. In particular, the side end portion 106*g* is formed such that any position in the surface does not project more outward in the width direction A4 than a position downstream in the media ejection direction A3 from any position in the surface. A lower end portion 106*h*, which is a lower surface of each of the left and right (outer) ends of the projection 106*d* of the base 106*b* in the width direction A4, is formed flat such that the lower end portion 106*h* has no step, that is, no projecting part projecting downward. In particular, the lower end portion 106*h* is formed such that any position in the surface does not project more downward than a position downstream in the media ejection direction A3 from any position in the surface. The lower end portion 106*h*, which is the lower surface of each of the left and right (outer) ends of the base 106*b* in the width direction A4, is formed flat such that the lower end portion 106*h* has no step not only in the projection 106*d* but also across both ends in the media ejection direction A3, that is, no projecting part projecting downward.

A side end portion 106*i*, which is a side surface of a downstream end of the attachment 106*c* in the media ejection direction A3, is formed flat such that the side end portion 106*i* has no step, that is, no projecting part projecting downstream in the media ejection direction A3. A lower end portion 106*j*, which is a lower surface of the downstream end of the attachment 106*c* in the media ejection direction A3, is formed flat such that the lower end portion 106*j* has no step, that is, no projecting part projecting downward.

A side end portion 106*k*, which is a side surface of each of the left and right (outer) ends of the attachment 106*c* in the width direction A4, is formed flat such that the side end portion 106*k* has no step, that is, no projecting part projecting outward in the width direction A4. In particular, the side end portion 106*k* is formed such that any position in the surface does not project more outward in the width direction A4 than a position downstream in the media ejection direction A3 from any position in the surface. A lower end portion 106*l*, which is a lower surface of each of the left and right (outer) ends of the attachment 106*c* in the width direction A4, is formed flat such that the lower end portion 106*l* has no step, that is, no projecting part projecting downward. In particular, the lower end portion 106*l* is formed such that any position in the surface does not project more downward than a position downstream in the media ejection direction A3 from any position in the surface.

Further, a rib 106*m* extending along the media ejection direction A3 is formed on the lower surface of the base 106*b*. The rib 106*m* is formed flat with no step, that is, no projecting part projecting outward in the width direction A4 and no projecting part projecting downward. In particular, the rib 106*m* is formed such that any position in the rib does not project more outward and downward in the width direction A4 than a position downstream in the media ejection direction A3 from any position in the rib. Similarly, a rib 106*n* extending along the media ejection direction A3 is formed on the lower surface of the attachment 106*c*. The rib 106*n* is formed flat with no step, that is, no projecting part projecting outward in the width direction A4 and no projecting part projecting downward. In particular, the rib 106*n* is formed such that any position in the rib does not project more outward and downward in the width direction A4 than a position downstream in the media ejection direction A3 from any position in the rib.

As in the case of the extension tray 106, a front-side surface and/or a lower surface of the downstream end of the ejection tray 105 in the media ejection direction A3 and/or a side surface and/or a lower surface of each of the left and right ends of the ejection tray 105 in the width direction A4 may be formed with no step. In addition, as in the case of the extension tray 106, the lower surface of the ejection tray 105 may be provided with a rib that is formed with no step and extends along the media ejection direction A3.

The ejection tray 105 and the extension tray 106 are not provided with ribs extending in the width direction A4.

Figure 11:
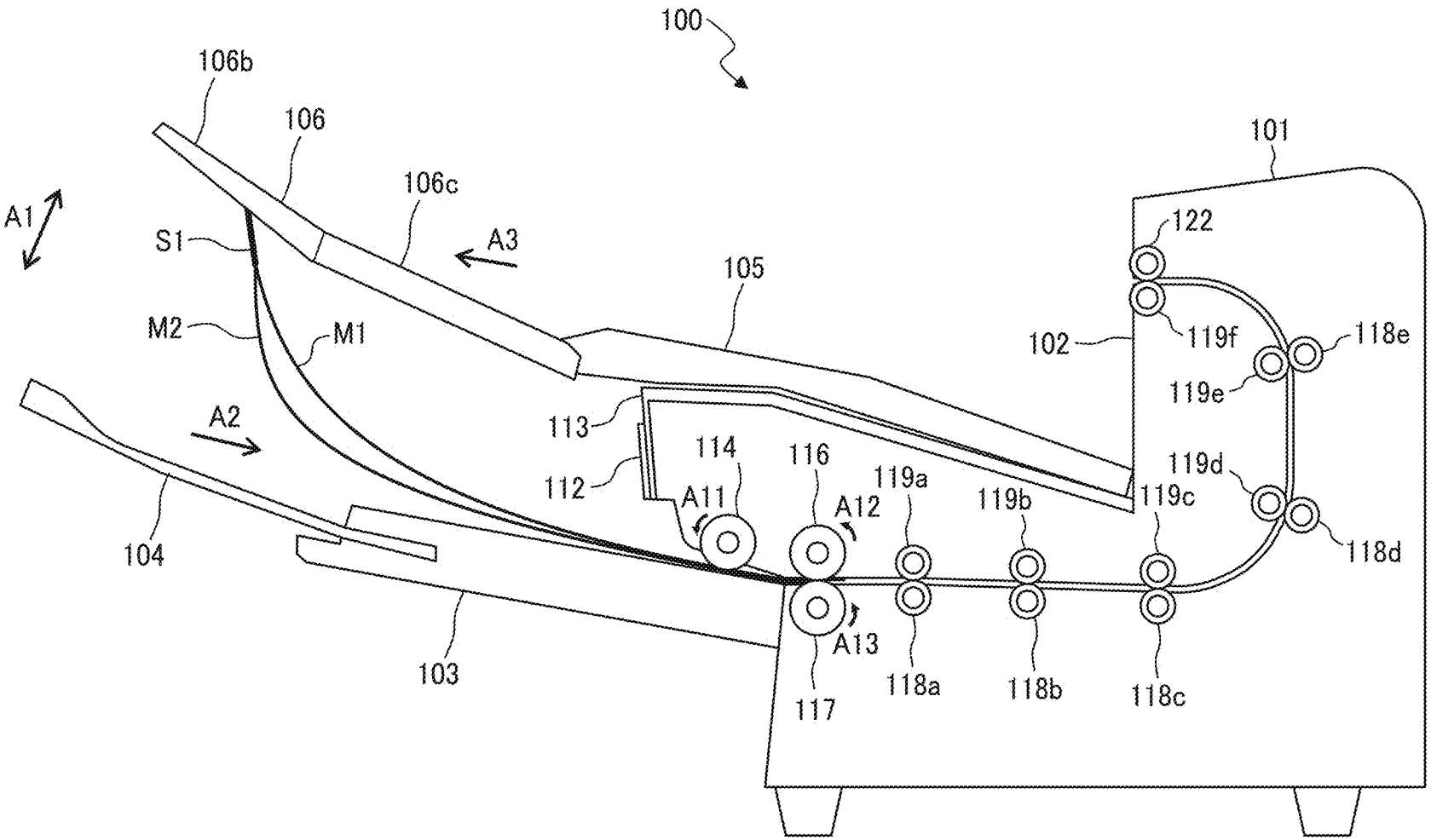
FIG. 11 is a schematic diagram illustrating a movement of media.

FIG. 11 is a schematic diagram illustrating a movement of media when the rear end of the media to be conveyed floats. FIG. 11 illustrates a state in which a plurality of media M1 and M2, which are bound with staples S1 at multiple positions on the rear end thereof, are conveyed.

When the media M1 and M2 whose rear end is bound with the staples S1 at multiple positions are conveyed, the uppermost medium M1 is fed by the feed roller 116 and the other medium M2 stays on the feed table 103 by the action of the separation roller 117. Accordingly, the portion bound with the staples S1 is pulled by the uppermost medium M1 and floats upward. Consequently, there is a possibility that surroundings of the portion bound with the staples S1 come into contact with the downstream end portion 106*e* of the projection 106*d*, or the respective lower end portions 106*f*, 106*h*, 106*j*, and 106*l* of the projection 106*d* or the attachment 106*c*. Since the downstream end portion 106*e* and the lower end portions 106*f*, 106*h*, 106*j*, and 106*l* have no step, it is possible to prevent the floating portion of the media from being caught by the end portions, prevent the damage to the media, and thus prevent the floating portion of the media from not reaching the first floating sensor 112. Accordingly, the media conveying apparatus 100 can reduce the possibility of damage to the floating portion of the media, and also prevent the damage to the media by appropriately detecting the floating of the media and stopping the conveyance of the media.

Figure 12:
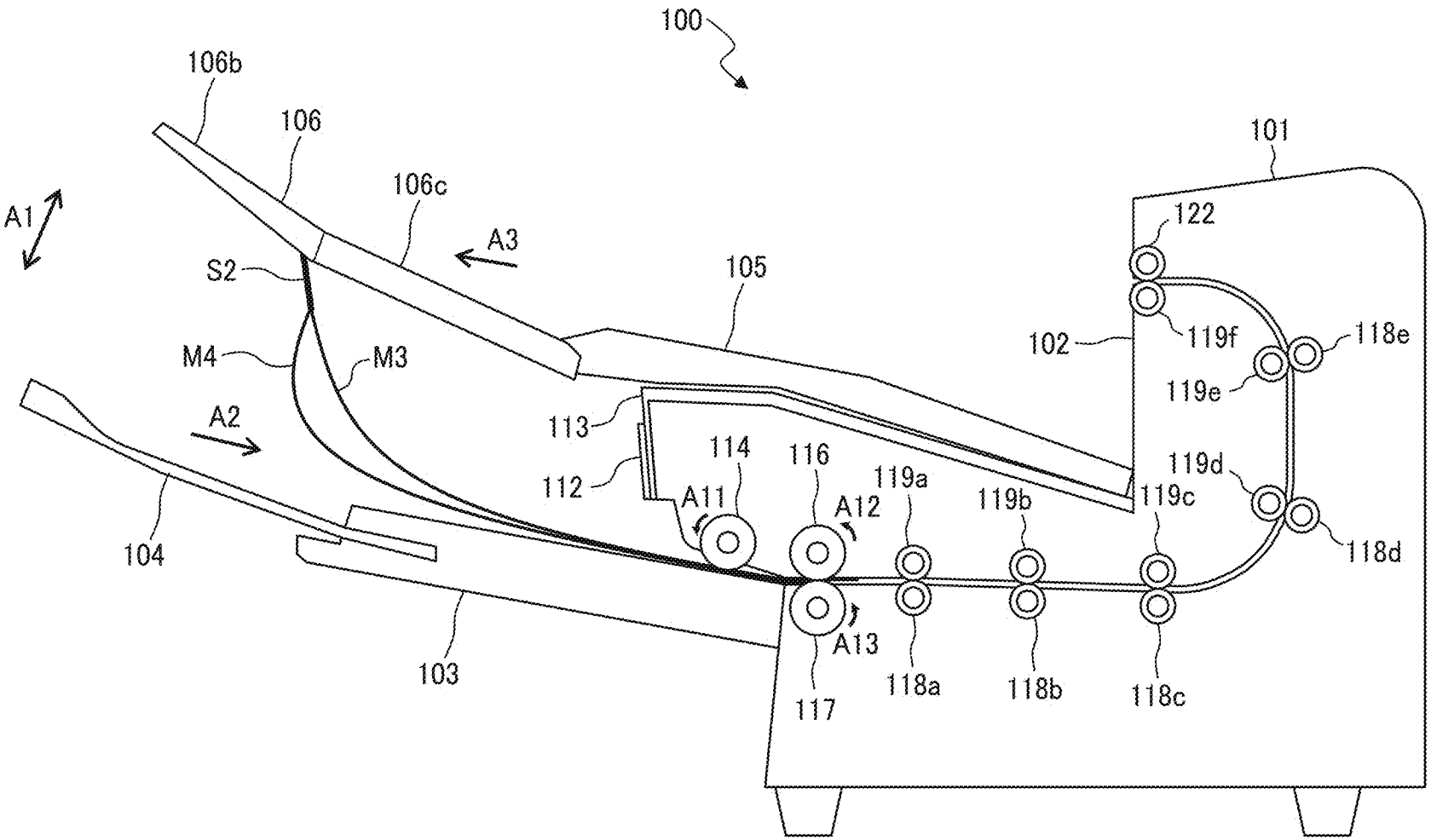
FIG. 12 is a schematic diagram illustrating a movement of media.

FIG. 12 is a schematic diagram illustrating a movement of media when the rear end of the media to be conveyed floats. FIG. 12 illustrates a state in which a plurality of media M3 and M4 whose corner on the rear end is bound with a staple S2 are conveyed.

When the media M3 and M4 whose rear end corner is bound with the staple S2 are conveyed, the portion bound with the staple S2 is pulled by the uppermost medium M3 and floats upward. Consequently, there is a possibility that surroundings of the portion bound with the staple S2 come into contact with each side end portion 106*g*, 106*i*, or 106*k* of the projection 106*d* or the attachment 106*c*, or each lower end portion 106*h*, 106*j*, or 106*l*. Since the side end portions 106*g*, 106*i*, and 106*k* and the lower end portions 106*h*, 106*j*, and 106*l* have no step, it is possible to prevent the floating portion of the media from being caught by the end portions, prevent the damage to the media, and thus prevent the floating portion of the media from reaching the first floating sensor 112. Accordingly, the media conveying apparatus 100 can reduce the possibility of damage to the floating portion of the media, and also prevent the damage to the media by appropriately detecting the floating of the media and stopping the conveyance of the media.

There is also a possibility that the surroundings of the portion bound with the staple S1 or S2 come into contact with the ribs 106*m* and 106*n*. Since the ribs 106*m* and 106*n* have no step, it is possible to prevent the floating portion of the media from being caught by the ribs, prevent the damage to the media, and thus prevent the floating portion of the media from not reaching the first floating sensor 112. Accordingly, the media conveying apparatus 100 can reduce the possibility of damage to the floating portion of the media, and also prevent the damage to the media by appropriately detecting the floating of the media and stopping the conveyance of the media.

As described above, the ejection tray 105 and the extension tray 106 are not provided with ribs extending in the width direction A4. Such a configuration prevents the floating portion of the media from being caught by the ribs extending in the width direction A4, prevents the damage to the media, and thus prevents the floating portion of the media from not reaching the first floating sensor 112. Accordingly, the media conveying apparatus 100 can reduce the possibility of damage to the floating portion of the media, and also prevent the damage to the media by appropriately detecting the floating of the media and stopping the conveyance of the media.

As described above, the lower end of the base 106*b* is located below the lower end of the attachment 106*c*. With such a configuration, when the media M3 and M4 whose corner on the rear end is bound with the staple S2 are conveyed, the entire media is pressed down by the lower end of the base 106*b*. Thus, the bound portion is prevented from floating, and the degree of floating is reduced. Accordingly, it is possible to prevent the floating portion of the media from being caught by the respective end portions, prevent the damage to the media, and thus prevent the floating portion of the media from not reaching the first floating sensor 112. Accordingly, the media conveying apparatus 100 can reduce the possibility of damage to the floating portion of the media, and also prevent the damage to the media by appropriately detecting the floating of the media and stopping the conveyance of the media.

As described above, the lower end of the extension tray 106 is located below the ejection tray 105, that is, on the position closer to the feed table 103 than the ejection tray 105. Accordingly, when the media M3 and M4 whose corner on the rear end is bound with the staple S2 are conveyed, the entire media is pushed down by the lower end of the extension tray 106. Thus, the floating of the bound portion is prevented and the degree of floating is reduced also at the position upstream from the extension tray 106 in the media ejection direction A3, that is, at the position where the ejection tray 105 is located. Such a configuration prevents the floating portion of the media from being caught by the respective ends of the ejection tray 105, prevents the damage to the media, and thus prevents the floating portion of the media from not reaching the first floating sensor 112. Accordingly, the media conveying apparatus 100 can reduce the possibility of damage to the floating portion of the media, and also prevent the damage to the media by appropriately detecting the floating of the media and stopping the conveyance of the media.

As described above, the lower end portion 106*h*, which is the lower surface of each of the left and right (outer) ends of the base 106*b* in the width direction A4, is formed flat such that the lower end portion 106*h* has no step across both ends in the media ejection direction A3, that is, no projecting part projecting downward. This prevents the floating portion of the media from being caught by the lower end portion 106*h*, prevents the damage to the media, and thus prevents the floating portion of the media from not reaching the first floating sensor 112. Accordingly, the media conveying apparatus 100 can reduce the possibility of damage to the floating portion of the media, and also prevent the damage to the media by appropriately detecting the floating of the media and stopping the conveyance of the media.

As illustrated in FIGS. 7 and 8, the side end portion 106*i*, which is a side surface of the downstream end of the attachment 106*c* in the media ejection direction A3, is positioned such that an outer position in the width direction A4 orthogonal to the media ejection direction A3 is located more upstream in the media ejection direction A3. The side end portion 106*i* is an example of an inclined surface in which an outer position in the width direction A4 orthogonal to the media ejection direction A3 is located more upstream in the media ejection direction A3. That is, the side end portion 106*i* inclines from outside to inside in the width direction A4 orthogonal to the media ejection direction to be more upstream in the media ejection direction. The extension tray 106 has an inclined surface downstream from the attachment 106*c* in the media ejection direction A3. The side end portion 106*i* is provided such that an angle θ1 formed between the side end portion 106*i* and the width direction A4 orthogonal to the media ejection direction A3 is greater than 0°, preferably 10° or more.

When the corner of the rear end bound with the staple S2 floats and comes into contact with the side end portion 106*i*, the floating portion is smoothly guided to the outside along the inclined side end portion 106*i*. This prevents the floating portion of the media from being caught by the side end portion 106*i*, prevents the damage to the media, and thus prevents the floating portion of the media from not reaching the first floating sensor 112. Accordingly, the media conveying apparatus 100 can reduce the possibility of damage to the floating portion of the media, and also prevent the damage to the media by appropriately detecting the floating of the media and stopping the conveyance of the media.

As in the case of the extension tray 106, the end surface of the downstream end of the ejection tray 105 in the media ejection direction A3 may be positioned such that an outer position in the width direction A4 is located more upstream in the media ejection direction A3.

In the width direction A4, the length of the extension tray 106 (the distance from the outer end of one attachment 106*c* to the outer end of the other attachment 106*c*) is preferably not less than two-thirds of the maximum media size supported by the media conveying apparatus 100. With such a configuration, even when the media of the maximum media size are stacked on the extension tray 106, end portions of the stacked media in the width direction A4 do not sag. Accordingly, even if the stapled media floats during conveyance, the floating portion does not come into contact the media stacked on the extension tray 106. Thus, the media conveying apparatus 100 can prevent the media stacked on the extension tray 106 from being damaged by contact with the staple of the floating media.

In the media ejection direction A3, it is preferable that the distance from the upstream end of the ejection tray 105 to the downstream end of the attachment 106*c* is greater than the maximum media size supported by the media conveying apparatus 100. Accordingly, even if the stapled media floats during conveyance, the floating portion does not come into contact the media stacked on the extension tray 106. Thus, the media conveying apparatus 100 can prevent the media stacked on the extension tray 106 from being damaged by contact with the staple of the floating media.

As illustrated in FIG. 9, the side end portion 106*i*, which is a side surface of the downstream end of the attachment 106*c* in the media ejection direction A3, is positioned such that a lower position with respect to the lower surface of the projection 106*d* is located more upstream in the media ejection direction A3. That is, the side end portion 106*i* is positioned such that a position closer to the feed table 103 is located more upstream in the media ejection direction A3. Thus, the side end portion 106*i* inclines from downstream to upstream in the media ejection to approach the feed table. The side end portion 106*i* is an example of an inclined surface in which a closer position to the feed table 103 is located more upstream in the media ejection direction A3. The extension tray 106 has an inclined surface downstream from the attachment 106*c* in the media ejection direction A3. The side end portion 106*i* is provided such that an angle θ2 formed between the side end portion 106*i* and the lower surface of the projection 106*d* is less than 90°, preferably 85° or less.

When the corner of the rear end bound with the staple S2 floats and comes into contact with the side end portion 106*i*, the floating portion is smoothly guided to the lower side, that is, toward the feed table 103 along the inclined side end portion 106*i*. This prevents the floating portion of the media from being caught by the side end portion 106*i*, prevents the damage to the media, and thus prevents the floating portion of the media from not reaching the first floating sensor 112. Accordingly, the media conveying apparatus 100 can reduce the possibility of damage to the floating portion of the media, and also prevent the damage to the media by appropriately detecting the floating of the media and stopping the conveyance of the media.

Similarly, as illustrated in FIG. 9, a downstream end portion 105*b*, which is an end surface of the downstream end of the ejection tray 105 in the media ejection direction A3, is positioned such that a lower position with respect to the lower surface of the extension tray 106 is located more upstream in the media ejection direction A3. That is, the downstream end portion 105*b* is positioned such that a closer position to the feed table 103 is located more upstream in the media ejection direction A3. The downstream end portion 105*b* is an example of an inclined surface in which a closer position to the feed table 103 is located more upstream in the media ejection direction A3. That is, the downstream end portion 105*b* inclines from the downstream side to the upstream side to approach the feed table. The ejection tray 105 has an inclined surface downstream from the ejection tray 105 in the media ejection direction A3. The downstream end portion 105*b* is provided such that an angle θ3 formed by the downstream end portion 105*b* and the lower surface of the extension tray 106 is less than 90°, preferably 85° or less.

When the corner of the rear end bound with the staple S2 floats and comes into contact with the downstream end portion 105*b*, the floating portion is smoothly guided to the lower side, that is, toward the feed table 103 along the inclined downstream end portion 105*b*. This prevents the floating portion of the media from being caught by the downstream end portion 105*b*, prevents the damage to the media, and thus prevents the floating portion of the media from not reaching the first floating sensor 112. Accordingly, the media conveying apparatus 100 can reduce the possibility of damage to the floating portion of the media, and also prevent the damage to the media by appropriately detecting the floating of the media and stopping the conveyance of the media.

As illustrated in FIG. 10B, the end surface of the downstream end of the ejection tray 105 in the media ejection direction A3 is provided with a connecting portion 105*c* connecting to the extension tray 106. On the other hand, the upstream end of the extension tray 106 in the media ejection direction A3 is provided with a connected portion 106*o* connected to the ejection tray 105. When the connected portion 106*o* is connected to the connecting portion 105*c*, the extension tray 106 is connected to the downstream side of the ejection tray 105 in the media ejection direction A3. In the state where the extension tray 106 is open, the connecting portion 105*c* does not project more downward (toward the feed table 103) than the connected portion 106*o* with respect to the lower surface of the extension tray 106. That is, in the state where the ejection tray 105 and the extension tray 106 cooperatively stack the media ejected from the ejector, the lower end portion of the extension tray 106 on the upstream side in the media ejection direction A3 is located closer to the feed table 103 than the lower end portion of the ejection tray 105 on the downstream side in the media ejection direction A3.

Figure 13:
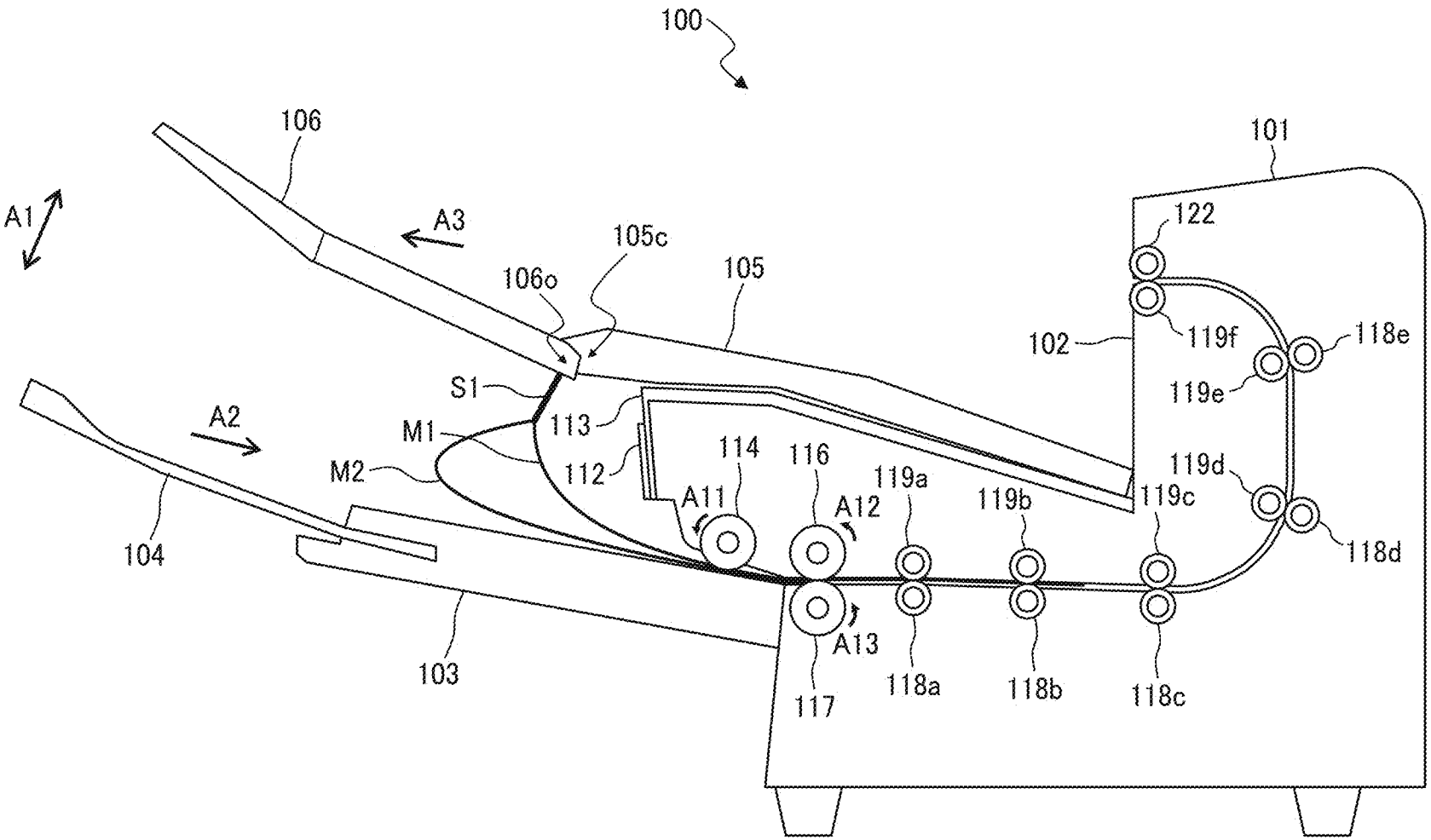
FIG. 13 is a schematic diagram illustrating a movement of media.
Figure 14:
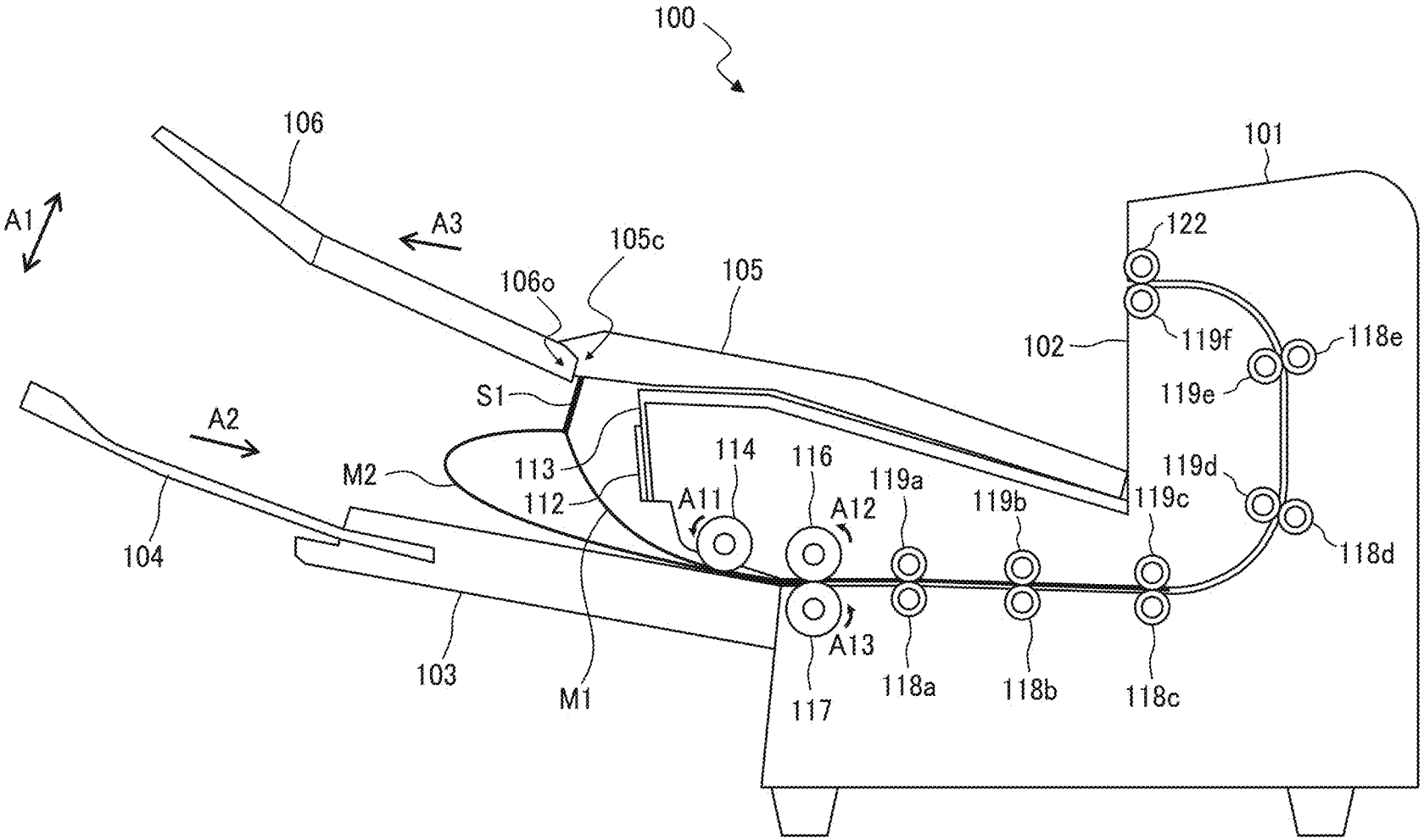
FIG. 14 is a schematic diagram illustrating a movement of media.

FIGS. 13 and 14 are schematic diagrams illustrating a movement of media when the rear end of the media to be conveyed floats. FIGS. 13 and 14 illustrates how a rear end of a plurality of media M1 and M2, which bound with staples S1 at multiple positions on the rear end, floats and passes through the joint between the extension tray 106 and the ejection tray 105.

As described above, the connected portion 106*o* of the extension tray 106 located on the downstream side in the media ejection direction A3 is located lower (closer to the feed table 103) than the connected portion 105*c* of the ejection tray 105 located on the upstream side in the media ejection direction A3. In other words, the connected portion 106*o* of the extension tray 106 located on the upstream side in the media conveyance direction A2 is located lower (closer to the feed table 103) than the connected portion 105*c* of the ejection tray 105 located on the downstream side in the media conveyance direction A2. When the rear end of the media M1 and M2 moves along the lower surface of the extension tray 106, such a configuration prevents the media M1 and M2 from colliding with the joint between the extension tray 106 and the ejection tray 105. This prevents the floating portion of the media from being caught by the joint between the extension tray 106 and the ejection tray 105, prevents the damage to the media, and thus prevents the floating portion of the media from not reaching the first floating sensor 112. Accordingly, the media conveying apparatus 100 can reduce the possibility of damage to the floating portion of the media, and also prevent the damage to the media by appropriately detecting the floating of the media and stopping the conveyance of the media.

Figure 15:
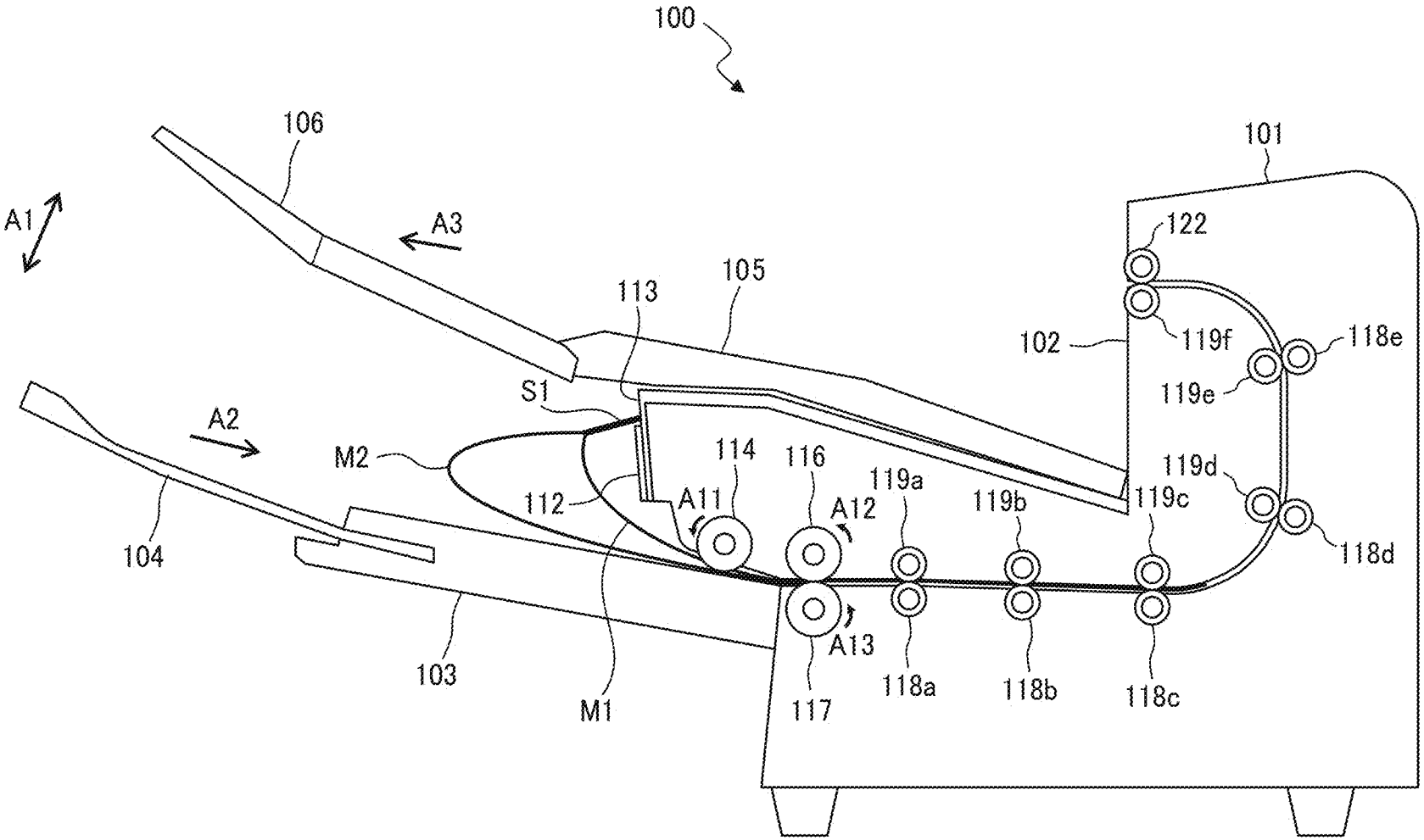
FIG. 15 is a schematic diagram illustrating a movement of media.

FIG. 15 is a schematic diagram illustrating a movement of media when the rear end of the media to be conveyed floats. FIG. 15 illustrates how a rear end of a plurality of media M1 and M2, which are bound with staples S1 at multiple positions on the rear end, floats and moves along the guide 113.

As described above, the guide 113 has the first guide face 113*a*, the second guide face 113*b*, and the third guide face 113*c* formed with no step. When the rear end of the media M1 and M2 is guided along the guide 113, such a configuration prevents the rear end of the media M1 and M2 from being caught by a step of the guide 113, prevents the damage to the media, and thus prevents the rear end of the media M1 and M2 from not reaching the first floating sensor 112. Accordingly, the media conveying apparatus 100 can reduce the possibility of damage to the floating portion of the media, and also prevent the damage to the media by appropriately detecting the floating of the media and stopping the conveyance of the media.

Figure 16:
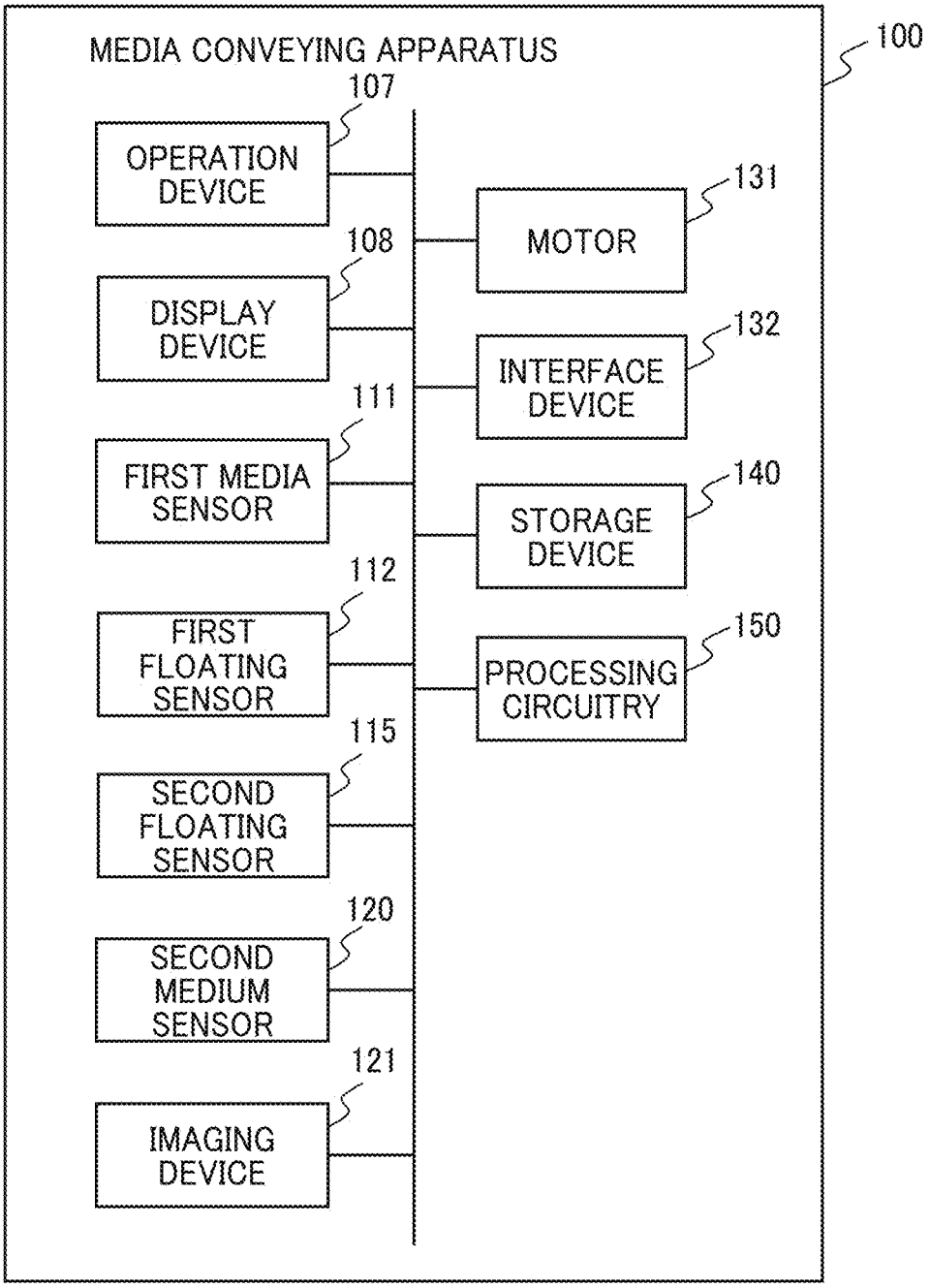
FIG. 16 is a schematic block diagram illustrating a configuration of the media conveying apparatus of FIG. 1.

FIG. 16 is a block diagram illustrating a schematic configuration of the media conveying apparatus 100.

The media conveying apparatus 100 further includes a motor 131, an interface device 132, a storage device 140, and processing circuitry 150 in addition to the above-described components.

The motor 131 includes one or more motors. The motor 131 rotates the pick roller 114, the feeding roller 116, the separation roller 117, the first to fifth conveyance rollers 118*a* to 118*e*, and/or the ejection roller 122 to convey media and move the feed table 103 in accordance with control signals from the processing circuitry 150. The first to sixth driven rollers 119*a* to 119*f* may be provided so as to rotate in accordance with the driving force of the motor 131, instead of rotating with the rotation of the first to fifth conveyance rollers 118*a* to 118*e* and the ejection roller 122.

The interface device 132 includes an interface circuit in compliance with a serial bus such as a universal serial bus (USB) and is electrically connected to an information processing device (for example, a personal computer or a mobile information processing terminal) to transmit and receive an input image and various kinds of information to and from the information processing device. The interface device 132 may be substituted by a communication unit including an antenna to transmit and receive radio signals and a wireless communication interface circuit to transmit and receive the signals through a wireless communication line according to a predetermined communication protocol. The predetermined communication protocol is, for example, a wireless local area network (LAN) communication protocol. The communication unit may include a wired communication interface circuit to transmit and receive signals through a wired communication line according to, for example, a wired LAN communication protocol.

The storage device 140 includes a memory device such as a random-access memory (RAM) or a read-only memory (ROM), a fixed disk device such as a hard disk, or a portable storage device such as a flexible disk or an optical disk. The storage device 140 stores, for example, computer programs, databases, and tables used for various processes performed by the media conveying apparatus 100. The computer programs may be installed in the storage device 140 from a computer-readable portable recording medium using, for example, a known setup program. The portable recording medium is, for example, a compact disc read-only memory (CD-ROM) and a digital versatile disc read-only memory (DVD-ROM). The computer programs may be distributed from, for example, a server and installed in the storage device 140.

The processing circuitry 150 operates based on a program previously stored in the storage device 140. The processing circuitry is, for example, a central processing unit (CPU). As the processing circuitry 150, for example, a digital signal processor (DSP), a large scale integration (LSI), an application-specific integrated circuit (ASIC), or a field-programmable gate array (FPGA) may be used.

The processing circuitry 150 is connected to the operation device 107, the display device 108, the first media sensor 111, the first floating sensor 112, the second floating sensor 115, the second media sensor 120, the imaging device 121, the motor 131, the interface device 132, the storage device 140, etc., and controls these components. The processing circuitry 150 controls, for example, the driving of the motors described above and the imaging by the imaging device 121, according to the signals received from the sensors described above. The processing circuitry 150 acquires an input image from the imaging device 121 and transmits the input image to the information processing apparatus via the interface device 132.

Figure 17:
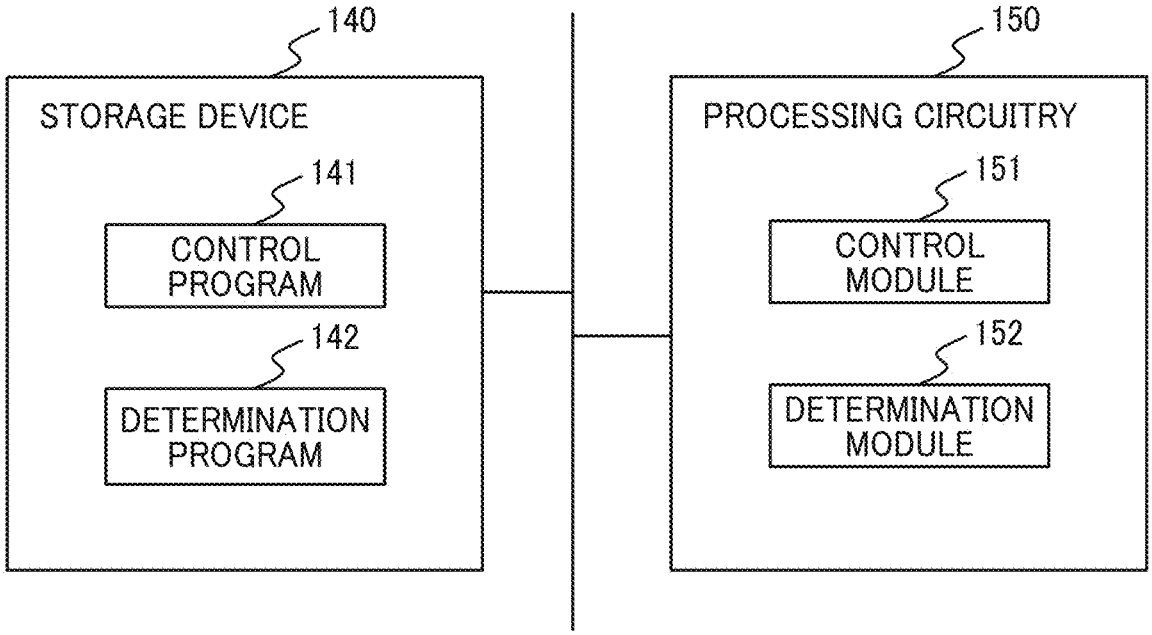
FIG. 17 is a schematic block diagram illustrating a configuration of a storage device and processing circuitry of the media conveying apparatus of FIG. 1.

FIG. 17 illustrates a schematic configuration of the storage device 140 and the processing circuitry 150.

As illustrated in FIG. 17, the storage device 140 stores, for example, a control program 141 and a determination program 142. These programs are functional modules implemented by software operating on a processor. The processing circuitry 150 reads the programs from the storage device 140 and operates according to the read programs. Thus, the processing circuitry 150 functions as a control module 151 and a determination module 152.

Figure 18:
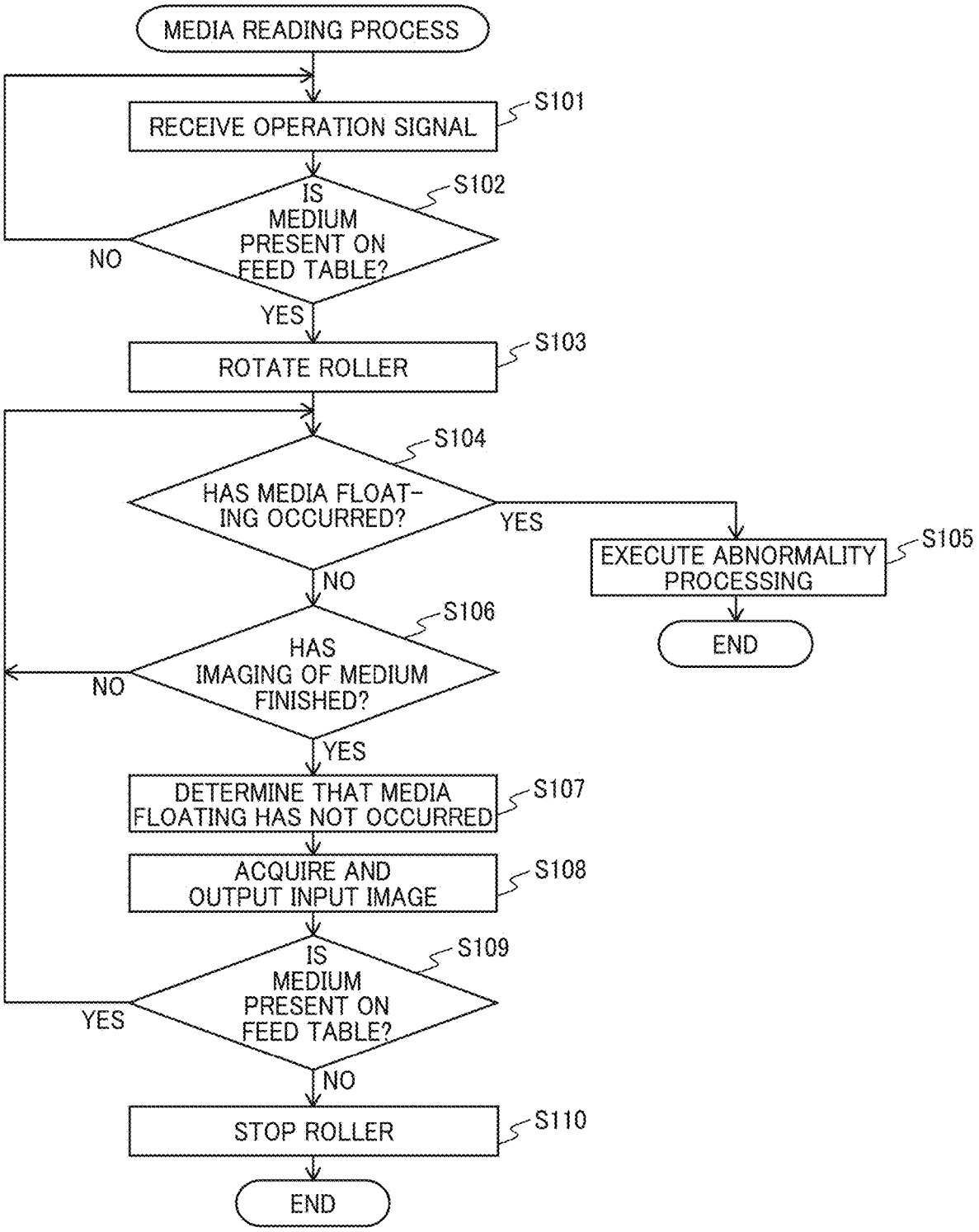
FIG. 18 is a flowchart of an example of an operation of a media reading process.

FIG. 18 is a flowchart of an example of a media reading process performed by the media conveying apparatus 100.

An example of the operation of the medium reading process of the media conveying apparatus 100 will be described below with reference to the flowchart illustrated in FIG. 18. The sequence of operations described below is executed, for example, by the processing circuitry 150 in cooperation with the components of the media conveying apparatus 100 based on the program prestored in the storage device 140.

In step S101, the control module 151 waits until an instruction to read a medium is input by the user using the operation device 107 or an information processing apparatus and an operation signal indicating the reading of the medium is received from the operation device 107 or the interface device 132.

In step S102, the control module 151 acquires a first media signal from the first media sensor 111 and, based on the acquired first media signal, determines whether a medium is placed on the feed table 103. If no medium is placed on the feed table 103, the control module 151 returns the process to step S101 and waits until a new operation signal is received from the operation device 107 or the interface device 132.

By contrast, when the medium is placed on the placing table 103, the control module 151 drives the motor 131 to feed and convey the medium (step S103). The control module 151 drives a motor for moving the feed table 103, and moves the feed table 103 to a position where the medium can be fed. Then, the control module 151 drives a motor for rotating each roller, and rotates the pick roller 114, the feeding roller 116, the separation roller 117, the first to fifth conveyance rollers 118*a* to 118*e*, the ejection roller 122, and/or the first to sixth driven rollers 119*a* to 119*f*. Accordingly, the control module 151 causes the medium placed on the feed table 103 to be fed and conveyed.

In step S104, the determination module 152 determines whether the floating of media has occurred. The determination module 152 acquires the first floating signal from the first floating sensor 112. When the signal value of the first floating signal indicates that a medium contacts the first contact member 112*a* or the second contact member 112*b*, the determination module 152 determines that media whose rear end is stapled have been conveyed and the floating of the media has occurred. The determination module 152 acquires a second floating signal from the second floating sensor 115. When the signal value of the second floating signal indicates that the arm 115*a* is raised by a medium, the determination module 152 determines that media whose leading end is stapled have been conveyed and the floating of the media has occurred. By contrast, when the signal value of the first floating signal does not indicate that a medium contacts the first contact member 112*a* or the second contact member 112*b* and the signal value of the second floating signal does not indicate that the arm 115*a* is raised by a medium, the determination module 152 determines that the floating of media does not occur.

When the determination module 152 determines that the floating of media has occurred, the control module 151 executes the abnormality processing (step S105) and ends the series of steps. The control module 151 stops the motor 131 and stops the feeding and conveyance of the medium as the abnormality processing. When the stapled media are conveyed and the floating of the media occurs, the control module 151 stops the feeding and conveyance of the media and thus can prevent the media from being damaged. The control module 151 may cause the display device 108 to display the status that the floating of the media has occurred as the abnormality processing, or may transmit the status to the information processing apparatus through the interface device 132 to notify the user of the warning.

By contrast, when the determination module 152 does not determine that the floating of the media has occurred, the control module 151 determines whether the imaging of the medium has been completed (step S106). The control module 151 periodically acquires a second media signal from the second media sensor 120. When the signal value of the second media signal changes from a value indicating the state where a medium is present to a value indicating the state where no medium is present, the control module 151 determines that the second media sensor 120 has detected the rear end of the medium. When a predetermined time has elapsed since the second media sensor 120 detected the rear end of the medium, the control module 151 determines that the rear end of the medium has passed the imaging position and that the imaging of the medium has been completed. The predetermined time is set to a time obtained by adding a margin to a time required for the medium to move from the second media sensor 120 to the imaging position of the imaging device 121. When the imaging of the medium has not yet been completed, the control module 151 returns the process to step S104 and repeats the process from step S104.

By contrast, when the imaging of the medium has been completed, the determination module 152 determines that the floating of media does not occur (step S107).

In step S108, the control module 151 acquires an input image from the imaging device 121, and transmits the acquired input image to the information processing apparatus via the interface device 132 to output the acquired input.

In step S109, the control module 151 determines whether a medium remain on the feed table 103 based on the first media signal received from the first media sensor 111. If a medium remains on the feed table 103, the control module 151 returns the process to step S104 and repeats the process from step S104.

By contrast, if no medium remains on the feed table 103, the control module 151 controls the motor 131 to stop each roller and controls the motor 131 to lower the feed table 103 to the lowermost position (step S110), and ends the series of steps.

As described above in detail, the media conveying apparatus 100 includes a portion that guides media to the first floating sensor 112 that detects the floating of the media. The guide has no step. Thus, when the floating of media occurs, the floating portion of the media is smoothly guided to the first floating sensor 112, and the first floating sensor 112 can detect the media more reliably. Accordingly, the media conveying apparatus 100 can appropriately cope with the occurrence of the floating of media while reducing the possibility of damage to the floating portion of the media, and can appropriately convey the media.

Even when the stapled media are conveyed, the damage to the media is prevented. Thus, the user does not need to check the presence of staple before scanning the media, and the media conveying apparatus 100 can enhance the convenience of the user. Even when a bent or curved medium is conveyed, the bent or curved portion of the medium is guided in a good manner. Thus, the user does not need to check the presence of the bent or curved portion of the medium before scanning the medium, and the media conveying apparatus 100 can enhance the convenience of the user.

Figure 19:
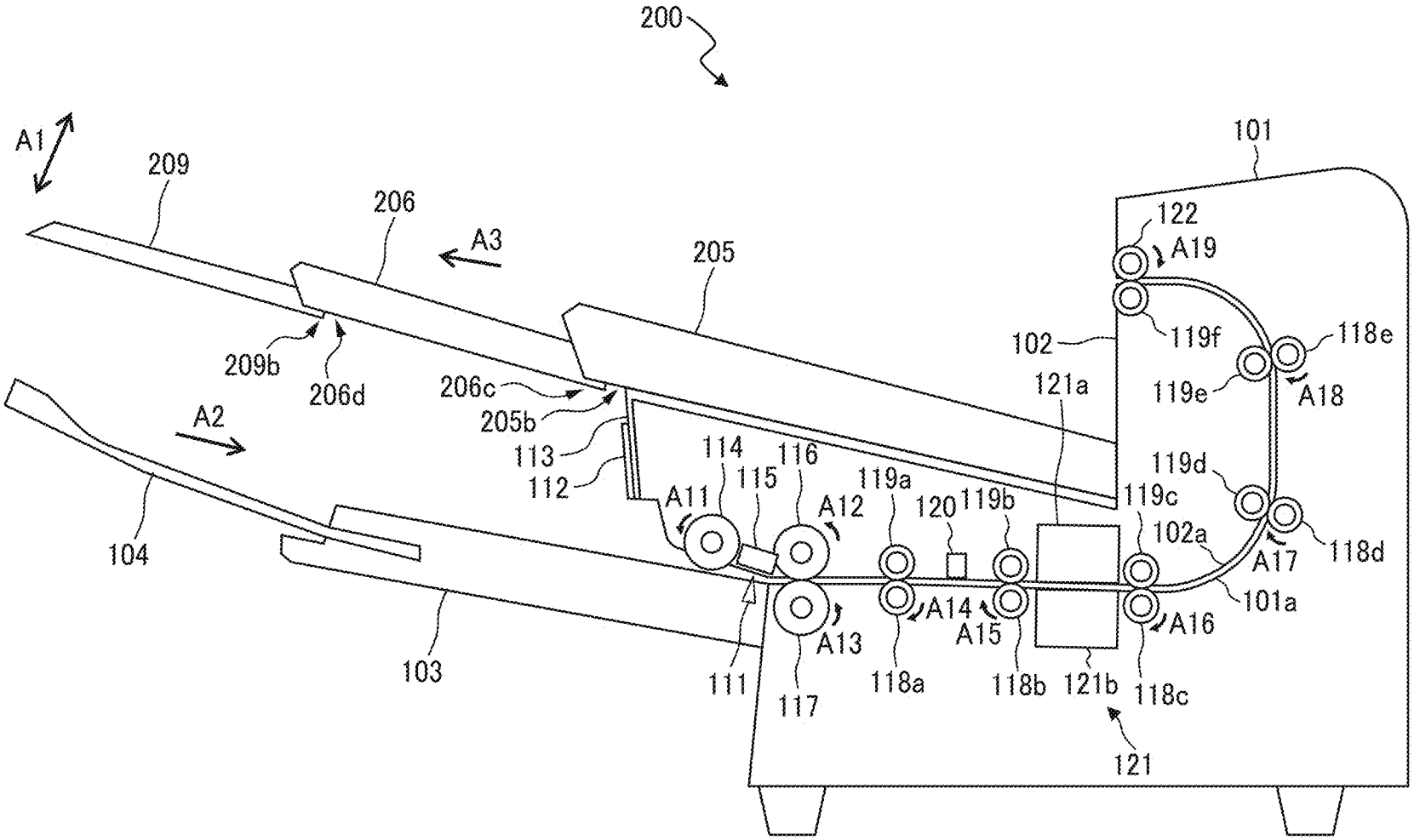
FIG. 19 is a schematic diagram illustrating another media conveying apparatus.

FIG. 19 is a schematic diagram illustrating a media conveying apparatus 200 according to another embodiment.

The media conveying apparatus 200 has the same configuration and functions as the media conveying apparatus 100. However, the media conveying apparatus 200 includes an ejection tray 205, a first extension tray 206, and a second extension tray 209 instead of the ejection tray 105 and the extension tray 106. The ejection tray 205, the first extension tray 206, and the second extension tray 209 are examples of trays. The first extension tray 206 and the second extension tray 209 are examples of extension trays. The ejection tray 205 has the same structure and functions as the ejection tray 105.

The first extension tray 206 is connected to the downstream side of the ejection tray 205 in the media ejection direction A3. The first extension tray 206 can be pulled out from a downstream end of the ejection tray 205 in the media ejection direction A3. When a medium of a small size (for example, A5 size or less) is ejected, the first extension tray 206 is stored in the ejection tray 205. By contrast, when a medium of a moderate size or larger (for example, a size larger than A5 size) is ejected, the first extension tray 206 is pulled out from the ejection tray 205 and is positioned to extend the ejection tray 205 downstream in the media ejection direction A3.

The second extension tray 209 is connected to the downstream side of the first extension tray 206 in the media ejection direction A3. The second extension tray 209 can be pulled out from a downstream end of the first extension tray 206 in the media ejection direction A3. When a medium of a moderate size (for example, a size larger than A5 size and equal to or smaller than A4 size) is ejected, the second extension tray 209 is stored in the first extension tray 206. By contrast, when a medium of a large size (for example, a size larger than A4 size) is ejected, the second extension tray 209 is pulled out from the first extension tray 206 and is positioned to extend the first extension tray 206 downstream in the media ejection direction A3.

The ejection tray 205, the first extension tray 206, and the second extension tray 209 are located above the feed table 103 so as to face the feed table 103, that is, so as to overlap the feed table 103 when viewed from the height direction A1. The first extension tray 206 and the second extension tray 209 cooperate with the ejection tray 205 to stack the media ejected from an ejection port of the first housing 101 and the second housing 102.

Figure 20:
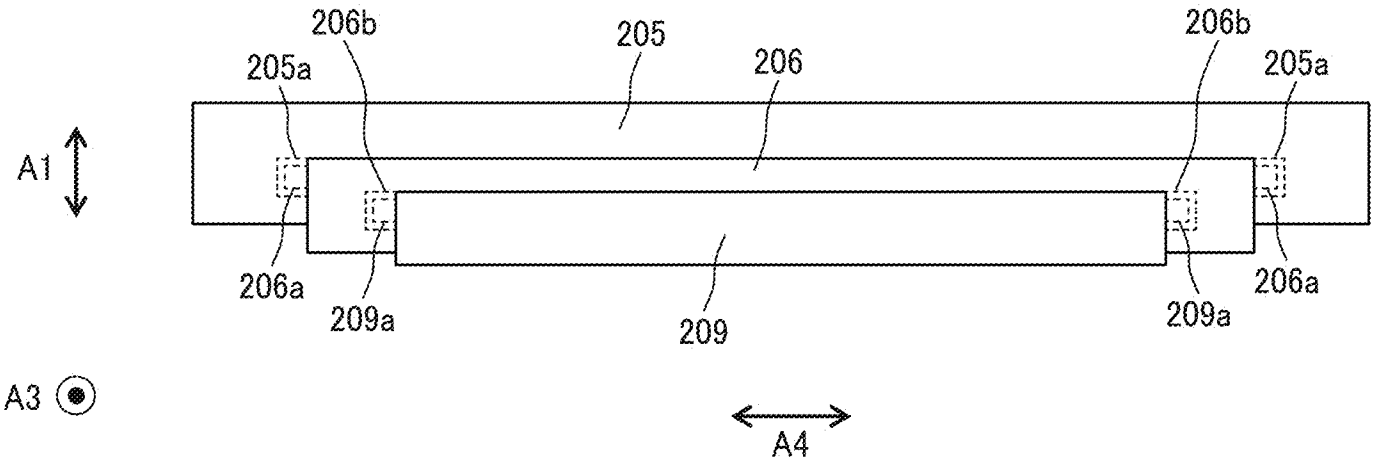
FIG. 20 is a schematic diagram illustrating an ejection tray.

FIG. 20 is a schematic view of the ejection tray 205, the first extension tray 206, and the second extension tray 209. FIG. 20 is a schematic view of the ejection tray 205, the first extension tray 206, and the second extension tray 209 viewed from downstream in the media ejection direction A3.

As illustrated in FIG. 20, guide portions 205*a* such as rails extending along the media ejection direction A3 are formed inside the ejection tray 205, and engaging portions 206*a* such as projections extending along the media ejection direction A3 are formed at the outer ends of the first extension tray 206 in the width direction A4. As the engaging portions 206*a* slide along the guide portions 205*a*, the first extension tray 206 slides with respect to the ejection tray 205. Similarly, guide portions 206*b* such as rails extending along the media ejection direction A3 are formed in the first extension tray 206, and engaging portions 209*a* such as projections extending along the media ejection direction A3 are formed at the outer ends of the second extension tray 209 in the width direction A4. As the engaging portions 209*a* sliding along the guide portions 206*b*, the second extension tray 209 slides with respect to the first extension tray 206.

The length of the first extension tray 206 in the width direction A4 is shorter than the length of the ejection tray 205 in the width direction A4, and the lower end of the first extension tray 206 is located below the lower end of the ejection tray 205 in the extending direction of the ejection tray 205, that is, at a position closer to the feed table 103 than the lower end of the ejection tray 205. The length of the second extension tray 209 in the width direction A4 is shorter than the length of the first extension tray 206 in the width direction A4, and the lower end of the second extension tray 209 is located below the lower end of the first extension tray 206 with respect to the extending direction of the first extension tray 206, that is, at a position closer to the feed table 103 than the lower end of the first extension tray 206.

As in the case of the extension tray 106, an end surface and/or a lower surface of a downstream end of the ejection tray 205, the first extension tray 206, and/or the second extension tray 209 in the media ejection direction A3 may be formed with no step. As in the case of the extension tray 106, side surfaces and/or lower surfaces of the left and right ends of the ejection tray 205, the first extension tray 206, and/or the second extension tray 209 in the width direction A4 may be formed with no step. As in the case of the extension tray 106, ribs extending in the media ejection direction A3 may be provided with no step on the lower surfaces of the ejection tray 205, the first extension tray 206, and/or the second extension tray 209. As in the case of the attachment 106*c* of the extension tray 106, a side surface of the downstream end of the ejection tray 205 and/or the first extension tray 206 in the media ejection direction A3 may be positioned such that an outer position of the side surface in the width direction A4 is located more upstream in the media ejection direction A3. As in the case of the attachment 106*c* of the extension tray 106, the side surface of the downstream end of the ejection tray 205 and/or the first extension tray 206 in the media ejection direction A3 may be positioned such that a position closer to the feed table 103 is located more upstream in the media ejection direction A3.

As illustrated in FIG. 19, a connected portion 206*c* located at the upstream end of the first extension tray 206 in the media ejection direction A3 is connected to a connected portion 205*b* located at the downstream end of the ejection tray 205 in the media ejection direction A3. Thus, the first extension tray 206 is connected to the downstream side of the ejection tray 205 in the media ejection direction A3. As described above, the lower end of the first extension tray 206 is located below the lower end of the ejection tray 205 in the extending direction of the ejection tray 205, that is, at the position closer to the feed table 103 than the lower end of the ejection tray 205. Accordingly, in the state where the first extension tray 206 is pulled out, the connecting portion 205*b* does not project more downward than the connected portion 206*c* with respect to the lower surface of the first extension tray 206. In other words, in the state where the ejection tray 205 and the first extension tray 206 cooperatively stack the media ejected from the ejector, the lower end portion of the first extension tray 206 on the upstream side in the media ejection direction A3 is located closer to the feed table 103 than the lower end portion of the ejection tray 205 on the downstream side in the media ejection direction A3. Thus, when the rear end of media moves along the lower surface of the first extension tray 206, such a configuration prevents the rear end of the media from colliding with the joint between the first extension tray 206 and the ejection tray 205.

Similarly, a connected portion 209*b* located at the upstream end of the second extension tray 209 in the media ejection direction A3 is connected to a connected portion 206*d* located at the downstream end of the first extension tray 206 in the media ejection direction A3. Thus, the second extension tray 209 is connected to the downstream side of the first extension tray 206 in the media ejection direction A3. As described above, the lower end of the second extension tray 209 is located below the lower end of the first extension tray 206 in the extending direction of the second extension tray 209, that is, at a position closer to the feed table 103 than the lower end of the first extension tray 206. Accordingly, in the state where the second extension tray 209 is pulled out, the connecting portion 206*d* does not project more downward than the connected portion 209*b* with respect to the lower surface of the second extension tray 209. In other words, in a state where the first extension tray 206 and the second extension tray 209 cooperatively stack media ejected from the ejector, the lower end portion of the second extension tray 209 on the upstream side in the media ejection direction A3 is located closer to the feed table 103 than the lower end portion of the first extension tray 206 on the downstream side in the media ejection direction A3. Thus, when the rear end of media moves along the lower surface of the second extension tray 209, such a configuration prevents the rear end of media from colliding with the joint between the second extension tray 209 and the first extension tray 206.

As described above, the media conveying apparatus 200 can appropriately convey media even when the extension tray can be pulled out.

Figure 21:
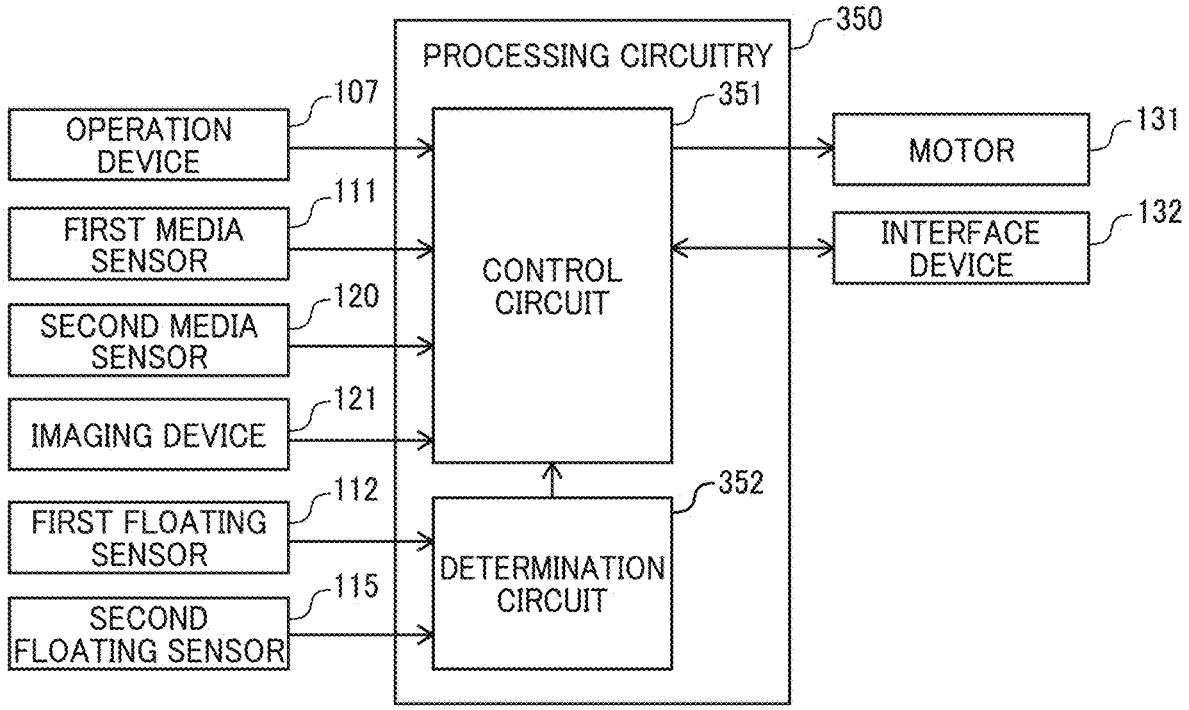
FIG. 21 is a block diagram illustrating a schematic configuration of other processing circuitry.

FIG. 21 is a diagram illustrating a schematic configuration of processing circuitry 350 of a media conveying apparatus according to still another embodiment.

The processing circuitry 350 is used instead of the processing circuitry 150 of the media conveying apparatus 100 or the media conveying apparatus 200, and executes, for example, a media reading process instead of the processing circuitry 150. The processing circuitry 350 includes, for example, a control circuit 351 and a determination circuit 352. These circuits may be independent integrated circuits, microprocessors, firmware, etc.

The control circuit 351 is an example of the control unit and has a function similar to that of the control module 151. The control circuit 351 receives the operation signal from the operation device 107 or the interface device 132. The control circuit 351 also receives a first media signal from the first media sensor 111 and a second media signal from the second media sensor 120. The control circuit 351 receives a determination result as to whether the floating of media has occurred from the determination circuit 352. The control circuit 351 controls the motor 131 based on the received information, acquires an input image from the imaging device 121, and outputs the input image to the interface device 132.

The determination circuit 352 is an example of a determination unit and functions in a similar manner to the determination module 152. The determination circuit 352 receives the first floating signal from the first floating sensor 112 and the second floating signal from the second floating sensor 115. The determination circuit 352 determines whether the floating of media has occurred based on each of the received signals, and outputs the determination result to the control circuit 351.

As described above, the media conveying apparatus can appropriately convey media even when the processing circuitry 350 is used.

Although several embodiments of the present disclosure have been described above, the embodiments are not limited thereto. For example, the ejection tray and the extension tray (the first extension tray and the second extension tray) may be located below the feed table 103. In this case, the guide 113 is also located around the first floating sensor 112 such that the guide 113 can guide the medium conveyed by the conveyors to the first floating sensor 112.

A distance measuring sensor may be used as the first floating sensor 112. The distance measuring sensor includes a light emitter and a light receiver. The light emitter emits light (infrared light or visible light) toward the feed table 103. On the other hand, the light receiver receives the light emitted by the light emitter and reflected by the feed table 103 or the medium to be conveyed. The distance measuring sensor generates, as a first floating signal, a signal corresponding to a time from when the light emitter emits light to when the light receiver receives the light. The signal value of the first floating signal varies depending on the distance from the distance measuring sensor to the medium, and therefore varies depending on whether the floating of media to be conveyed occurs.

An ultrasonic sensor may be used as the first floating sensor 112. The ultrasonic sensor includes an ultrasonic transmitter and an ultrasonic receiver located above the feed table 103 and at both ends in the width direction A4 so as to face each other. The ultrasonic transmitter transmits an ultrasonic wave toward the ultrasonic receiver. The ultrasonic receiver receives the ultrasonic wave transmitted from the ultrasonic transmitter. The ultrasonic sensor generates a signal corresponding to the intensity of the ultrasonic wave received by the ultrasonic receiver as a first floating signal. When a medium is present between the ultrasonic transmitter and the ultrasonic receiver, the ultrasonic wave transmitted from the ultrasonic transmitter is attenuated by the medium. Accordingly, the signal value of the first floating signal varies depending on whether the floating of media to be conveyed occurs.

A distance measuring sensor may be used as the second floating sensor 115. The distance measuring sensor includes a light emitter and a light receiver. The light emitter emits light (infrared light or visible light) toward the media conveyance passage. On the other hand, the light receiver receives the light emitted by the light emitter and reflected by the first guide 101*a* or the medium to be conveyed. The distance measuring sensor generates, as a second floating signal, a signal corresponding to a time from when the light emitter emits light to when the light receiver receives the light. The signal value of the second floating signal varies depending on the distance from the distance measuring sensor to the medium, and therefore varies depending on whether the floating of media to be conveyed occurs.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. Any one of the above-described operations may be performed in various other ways, for example, in an order different from the one described above.

The invention claimed is:

1. A media conveying apparatus, comprising:

a feed table on which a medium is placed;

a conveyor to convey the medium placed on the feed table;

a sensor to detect floating of the medium conveyed by the conveyor;

an ejector to eject the medium conveyed by the conveyor;

an ejection tray located above the feed table to stack the medium ejected by the ejector; and an extension tray connected to a downstream side of the ejection tray in a media ejection direction, wherein, in a state where the medium ejected from the ejector is stacked on the ejection tray and the extension tray, a lower surface of the extension tray and a lower surface of the ejection tray face the feed table, to guide the medium conveyed by the conveyor to the sensor, and a lower end portion of the extension tray on an upstream side in the media ejection direction is located closer to the feed table than a lower end portion of the ejection tray on a downstream side in the media ejection direction.

2. The media conveying apparatus according to claim 1, wherein the ejection tray has an inclined surface on the downstream side in the media ejection direction that inclines from the downstream side to the upstream side to approach the feed table.

3. A media conveying apparatus, comprising:

a feed table on which a medium is placed;

a conveyor to convey the medium placed on the feed table;

a sensor to detect floating of the medium conveyed by the conveyor; and a guide to guide a rear end of the medium conveyed by the conveyor to the sensor so that the rear end comes into contact with the sensor, wherein the guide has a guide face with no step, and wherein the sensor projects from the guide.

4. A media conveying apparatus, comprising:

a feed table on which a medium is placed;

a conveyor to convey the medium placed on the feed table;

a sensor to detect floating of the medium conveyed by the conveyor;

an ejector to eject the medium conveyed by the conveyor; and a tray located above the feed table to stack the medium ejected by the ejector, wherein, the tray includes:

a base; and an attachment connected to at least one of a left side or a right side of the base, a lower surface of the base and a lower surface of the attachment face the feed table, to guide the medium conveyed by the conveyor to the sensor, a lower end of the base is located closer to the feed table than a lower end of the attachment, lower left and right end portions of a projection of the base projecting more downstream than the attachment in a media ejection direction have no step, and a lower end portion of the attachment on a downstream side in the media ejection direction have no step.

5. The media conveying apparatus according to claim 4, wherein the attachment has an inclined surface on the downstream side in the media ejection direction that inclines from outside to inside in a direction orthogonal to the media ejection direction to be more upstream in the media ejection direction.

6. The media conveying apparatus according to claim 4, wherein the attachment has an inclined surface on the downstream side in the media ejection direction that inclines from downstream to upstream in the media ejection direction to approach the feed table.

7. The media conveying apparatus according to claim 4, wherein the lower left and right end portions of the base have no step across both ends in the media ejection direction.

8. The media conveying apparatus according to claim 4, wherein lower left and right end portions of the attachment have no step.

* * * * *